US005145385A

United States Patent [19]

Takano

[11] Patent Number: 5,145,385

[45] Date of Patent: Sep. 8, 1992

[54] ELECTRICAL CONNECTOR DEVICE

[75] Inventor: Tsunesuke Takano, Tokyo, Japan

[73] Assignee: Kabushiki Kaisha T AN T, Tokyo, Japan

[21] Appl. No.: 707,106

[22] Filed: May 29, 1991

[30] Foreign Application Priority Data

| | | | |
|---|---|---|---|
| Jun. 14, 1990 | [JP] | Japan | 2-63040 |
| Jun. 20, 1990 | [JP] | Japan | 2-65316 |
| Jul. 24, 1990 | [JP] | Japan | 2-78298 |
| Jul. 24, 1990 | [JP] | Japan | 2-78299 |
| Aug. 6, 1990 | [JP] | Japan | 2-83198 |
| Aug. 6, 1990 | [JP] | Japan | 2-83199 |
| Aug. 20, 1990 | [JP] | Japan | 2-87165 |
| Aug. 20, 1990 | [JP] | Japan | 2-87166 |

[51] Int. Cl.[5] ..... H01R 23/68

[52] U.S. Cl. ..... 439/79; 439/374

[58] Field of Search ..... 439/55, 79, 80, 76, 439/629, 630, 329, 374; 361/395, 399, 404, 406, 407, 413

[56] References Cited

U.S. PATENT DOCUMENTS

| | | | |
|---|---|---|---|
| 4,397,511 | 8/1983 | Clark et al. | 439/633 |
| 4,449,767 | 5/1984 | Weidler | 439/79 |

FOREIGN PATENT DOCUMENTS 58-10306 2/1983 Japan .

*Primary Examiner*—Neil Abrams
*Attorney, Agent, or Firm*—Nixon & Vanderhye

[57] ABSTRACT

An electrical connector device allows interconnection between a male connector piece and a female connector plug. The device includes an insulating base having a mounting region and a restraining wall which projects upwardly therefrom. The restraining wall defines at least one slit oriented in a plane which is parallel to the restraining wall. A tubular housing establishes an interior space which is sized and configured to accept the female connector plug therewithin. The housing is coupled to the mounting region of the insulating base and has a forward end engages the restraining wall and a rearward end which receives the female connector plug. At least one electrically conductive strip having a leg portion is positioned within the slit of said restraining wall. The conductive strip includes a terminal end portion which is bent so as to be disposed within a transverse plane relative to the slit and thereby extend into the interior space of the tubular housing. The bent terminal end of the conductive strip thus forms the male connector piece which is mateable with the female connector plug inserted within the housing.

11 Claims, 33 Drawing Sheets

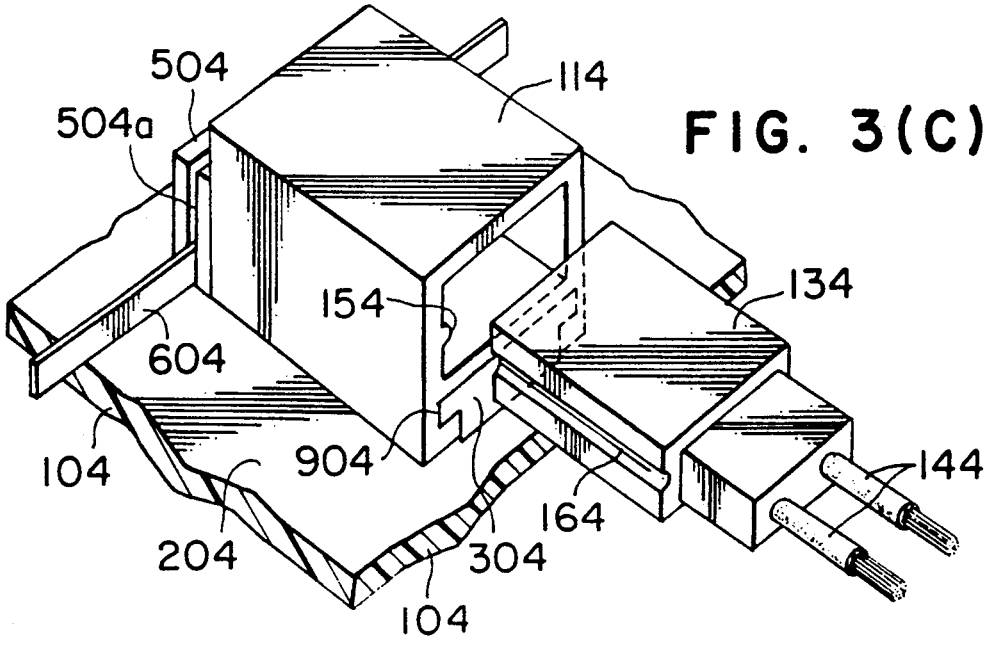
FIG. 3(C)
FIG. 4(A)
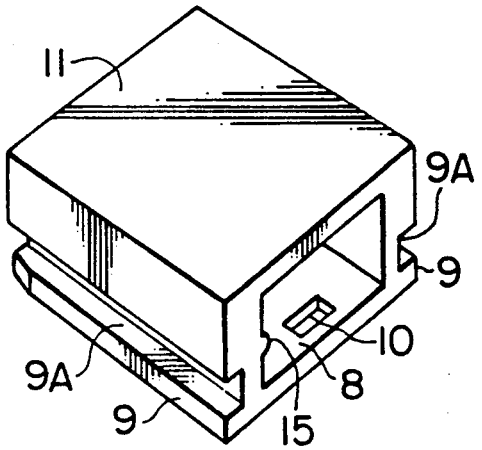
FIG. 4(B)
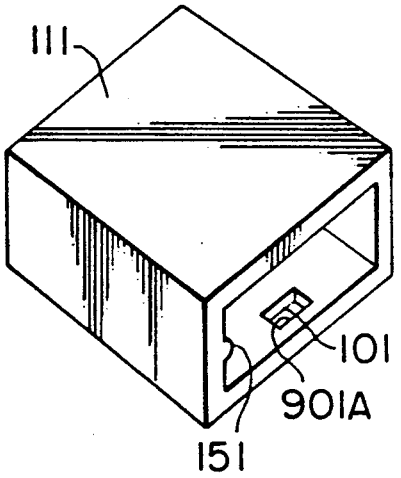
FIG. 4(C)
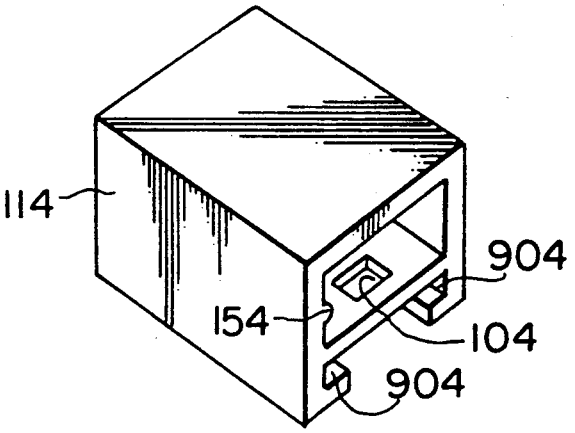

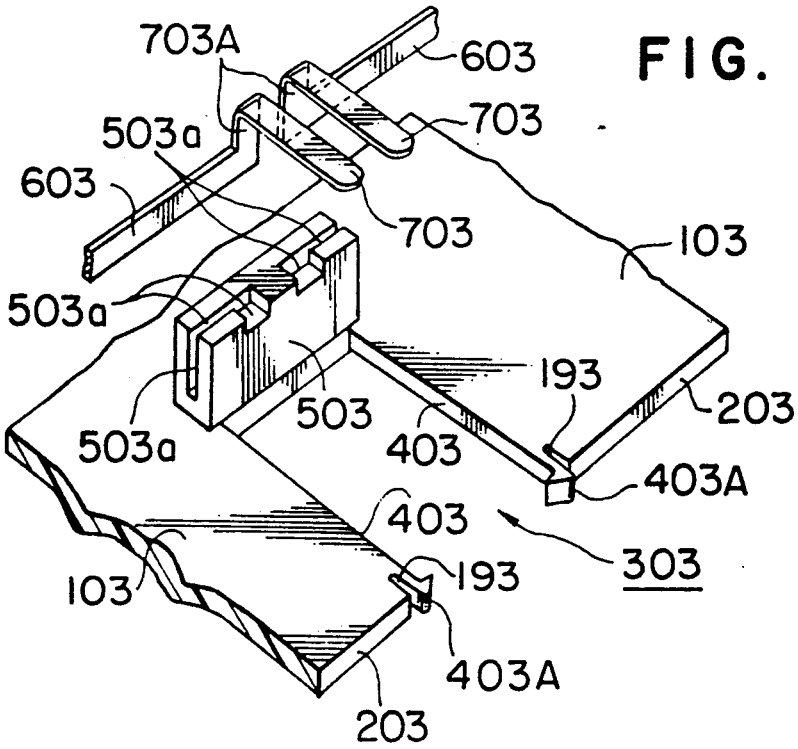
FIG. 28
FIG. 29
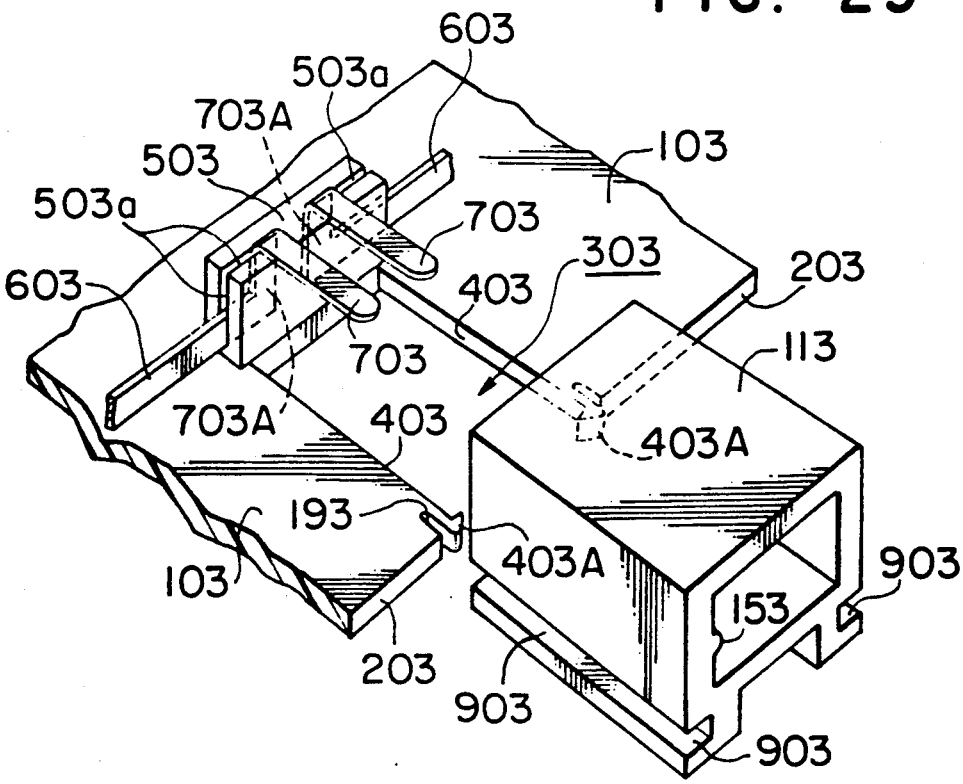

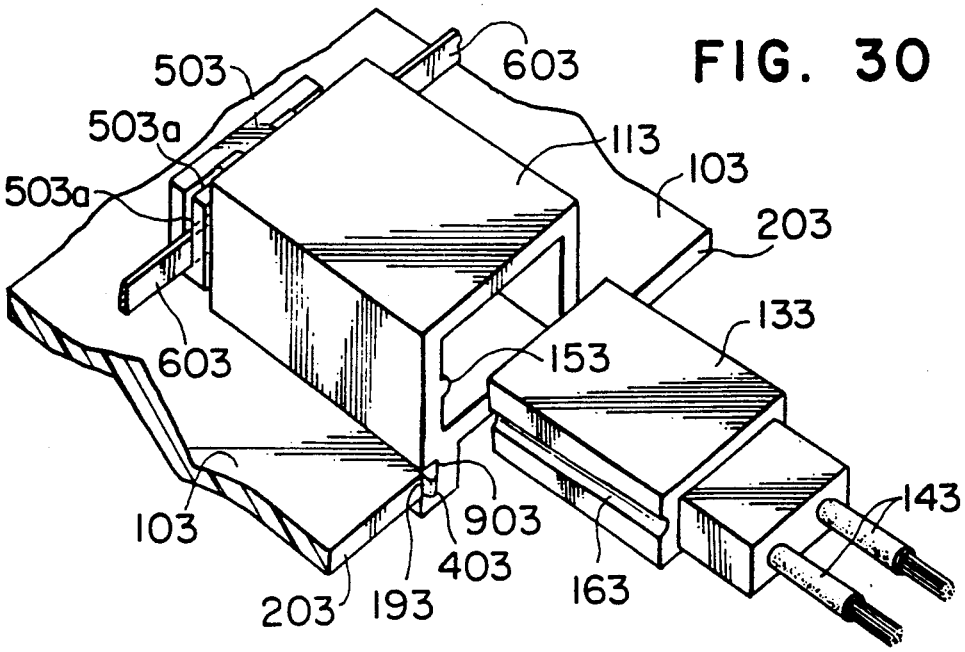
FIG. 30
FIG. 31(A)
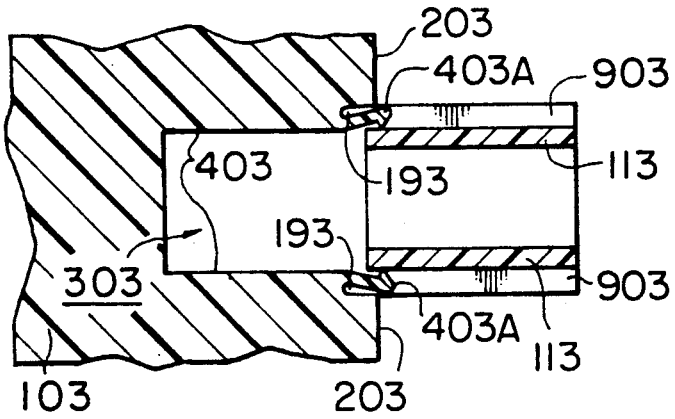
FIG. 31(B)
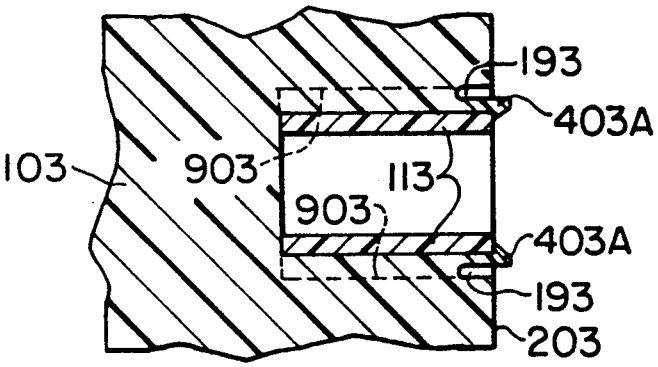

ELECTRICAL CONNECTOR DEVICE

BACKGROUND OF THE INVENTION

1. Field of the Invention

The present invention relates to an electrical connector device and, more particularly, to a connector device in which the bent base portions of narrow conducting strips, commonly referred to as BUS bars, are held in position by being inserted into slits provided in a protruding wall of an insulating base, thereby preventing the bent pieces of the narrow conducting strips from being deformed or displaced by an external force.

Japanese Utility Model Examined Publication No. 58-10306 discloses an example of a connector housing which performs electrical connection.

This connector housing of the prior art accommodates a plurality of female bipolar terminals which fit at their one end onto a plurality of parallel male terminals. This connector housing has a frame which opens at its upper and lower ends. Partition walls extending perpendicularly to the longitudinal walls of the frame are provided within the frame so as to form a plurality of terminal receiving chambers. Tapered guide surfaces are formed on the lower ends of the left and right side walls and the paritition walls. The lower ends of said partition walls are positioned out of alignment with the lower end opening of the frame.

In use, a separately prepared cover plate having a central bore is fastened by screws to a circuit board in such a manner that a flange radially extending from a lower portion of the frame is pressed by the portion of the cover plate around the central bore, whereby the housing is attached to the circuit board.

Thus, the known connector housing requires a separately prepared cover plate, which makes administration of parts difficult and raises the cost of the connector. Furthermore, fastening of the cover plate with screws is considerably laborious, particularly in a dark place or when space is restricted. In addition, it is necessary to use a special tool such as a screw driver.

In this known connector housing, it is impossible to fix the base portions of narrow strips rising from the circuit board (bent pieces) with the lower surface of the housing. Rather, the arrangement is such that the upper surface of the circuit board that is spaced apart from the base portions is pressed onto a wiring board at the lower end of the tapered inner surface of the flange provided on the housing. Therefore, the rising portions of the narrow strips mentioned above are liable to be deformed or displaced by an external force.

SUMMARY OF THE INVENTION

Accordingly, the object of the present invention is to prevent the bent pieces from being deformed or displaced by inserting the base portions of the bent pieces (rising base portions) of narrow conducting strips arranged on an insulating base directly into slits formed in a projecting wall on the insulating base, together with eliminating the need for a cover plate and its screws by locking a resilient locking piece of said insulating base onto the locking edge of a heat-resistant cylinder, thus overcoming the above-described problems of the prior art.

The above-mentioned object of the present invention is achieved by providing an electrical connector device comprising: an insulating base molded from plastic; locking projections, a resilient locking piece and a projecting wall provided on one side of said insulating base; narrow conducting strips inserted into slits; bent pieces formed from said narrow conducting strips; a cylinder, in which is formed an opening through which said bent pieces pass, and side pieces, which engage with said locking projections, and which is attached to and locked in position on said insulating base by means of said resilient locking piece through a locking edge; and, a male engaging member equipped with female connecting pieces, into which are inserted said bent pieces within said cylinder; wherein, bases of said bent pieces are held inside said projecting wall by being inserted into said slits.

By inserting the bases of bent pieces of narrow conducting strips (BUS bars) arranged and fixed on an insulating base into slits formed in a projecting wall on that insulating base, the bent pieces are able to be held in the projecting wall. This prevents the bent pieces from being deformed or displayed by an external force such as that resulting from being attached and removed from the female connecting pieces.

In addition, the cylinder is able to be attached and mounted in the manner of a so-called "cassette locking" mechanism by a resilient locking piece of the insulating base entering and locking into position with a clicking action onto a locking edge of the cylinder. During this mounting, since the bent pieces of this BUS bar are previously held in the slits in the projecting wall as stated above, automatic mounting is easy.

Moreover, during the course of this mounting, the upper surface of other BUS bars embedded in the upper surface of the insulating base can be protected by being covered with the lower surface of the cylinder.

BRIEF DESCRIPTION OF THE DRAWINGS

The drawings indicate one embodiment of the present invention. FIG. 4A is a perspective view indicating another embodiment of the cylinder.

FIG. 4B is a perspective view indicating another embodiment of the cylinder.

FIG. 28 is a perspective view of the state in which the insulating base and narrow conducting strips are separated. FIG. 29 is a perspective view of the state in which the narrow conducting strips are attached to the insulating base and the cylinder is facing the insulating base. FIG. 30 is a perspective view of the state in which the cylinder has been attached to the insulating base and the male engaging member is facing the cylinder. FIG. 31(*a*) is a transverse sectional top view indicating the state in which the cylinder is partially inserted onto the insulating base. FIG. 31(*b*) is a transverse sectional top view of the same following insertion.

FIG. 3C is a perspective view of the state in which the cylinder has been attached to the insulating base and the male engaging member is facing the cylinder. FIG. 4C is a perspective view indicating another embodiment of the cylinder.

DETAILED DESCRIPTION OF THE PREFERRED EMBODIMENTS

A first embodiment of the present invention will be described with reference to the drawings.

Figure 1A:
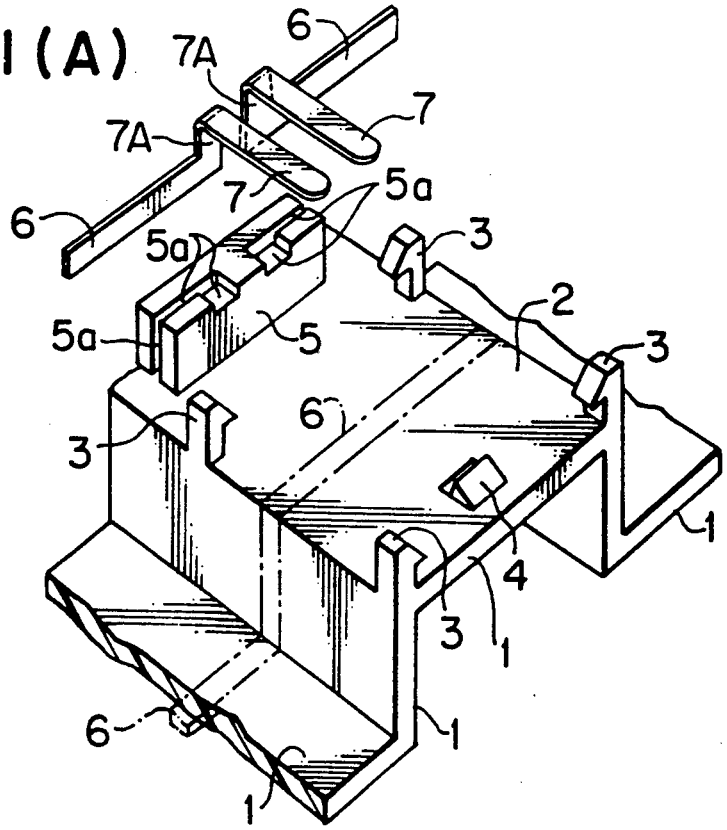
FIG. 1A is a perspective view of the state in which the insulating base and narrow conducting strips are separated.

Firstly, the basic composition of the present invention consists of at least two locking projections 3 and at least one resilient locking piece 4 formed on an insulating base 1 made of plastic, etc. as indicated in FIG. 1A.

Figure 2A:
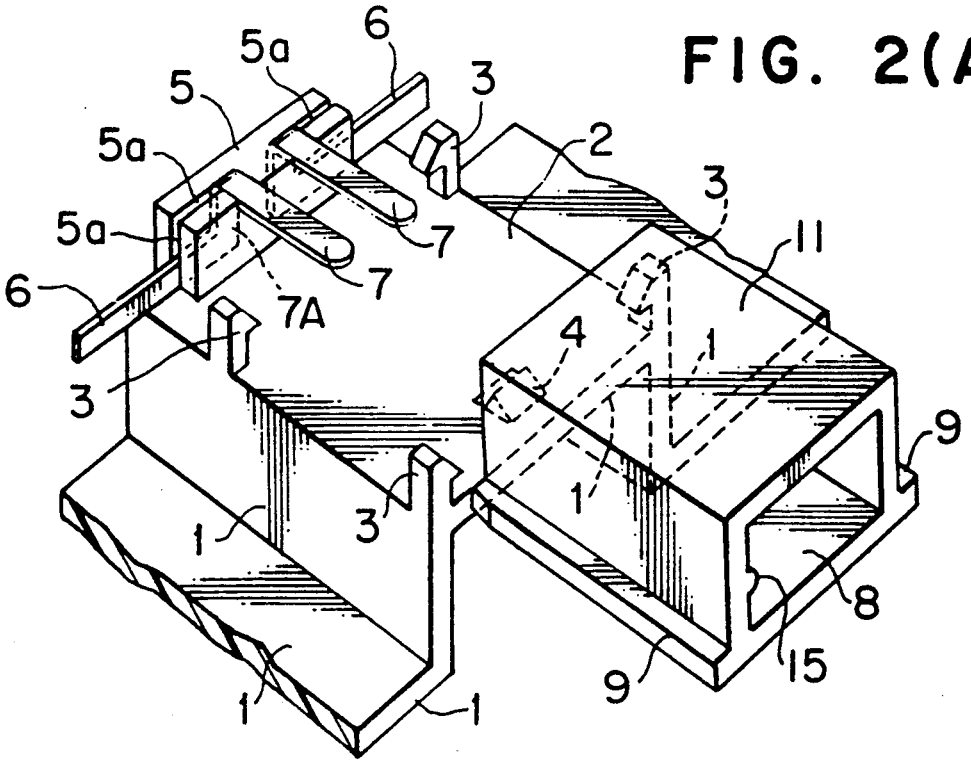
FIG. 2A is a perspective view of the state in which the narrow conducting strips are attached to the insulating base and the cylinder is facing the insulating base.

Bent pieces 7 are provided by being formed and bent nearly in parallel on, for example, the ends of narrow conducting strips 6 in the shape of narrow metal bands as indicated in FIG. 1A, which are used by inserting and fixing in slits 5*a* provided in the longitudinal direction in projecting wall 5 provided in an integrated manner on the upper surface of said insulating base 1 as indicated in FIG. 2A.

Figure 5A:
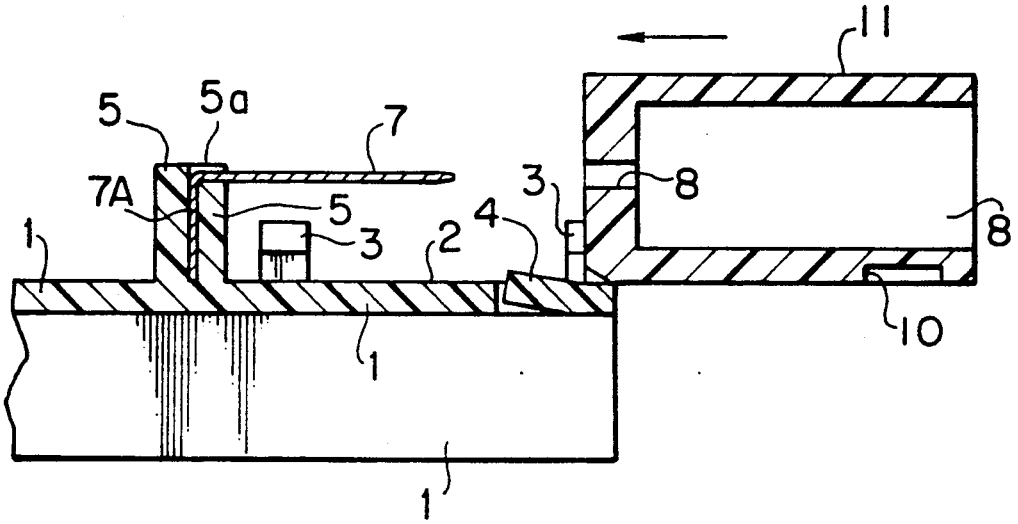
FIG. 5A is a longitudinal sectional side view of the embodiment indicated in FIG. 2A.

In addition, bases 7A of said bent pieces 7 are inserted in the manner described above into slits 5*a* of said projecting wall 5 and held there as indicated in FIG. 2A and FIG. 5A.

Figure 6A:
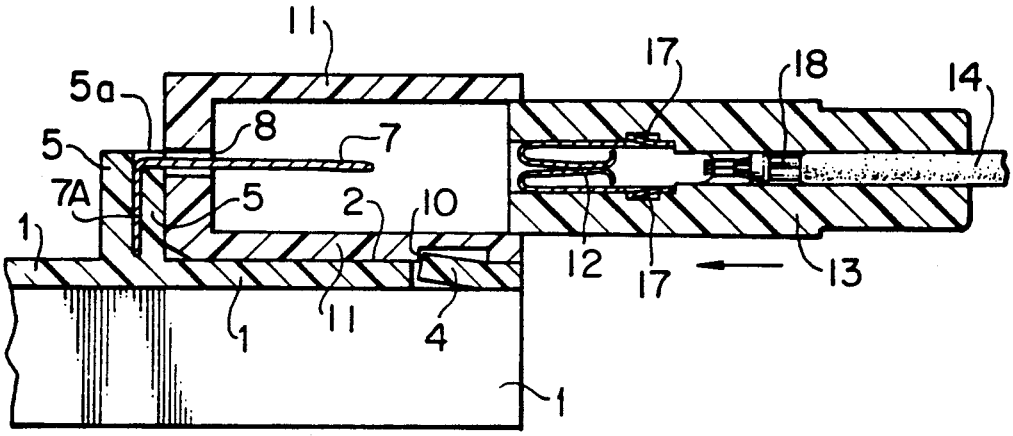
FIG. 6A is a longitudinal sectional side view of the embodiment indicated in FIG. 3A.

Moreover, opening 8, through which said bent pieces 7 pass as shown in FIG. 5A, and side pieces 9, which engage with said locking projections 3 as indicated in FIG. 2A, are respectively formed in cylinder 11 made of heat-resistant plastic such as Nylon 66 possessing insulating properties, which is attached and locked into position on the insulating base 1 as indicated in FIG. 6A via the state indicated in FIG. 5A by means of resilient locking piece 4 through locking edge 10 as indicated in FIG. 1A.

Figure 3A:
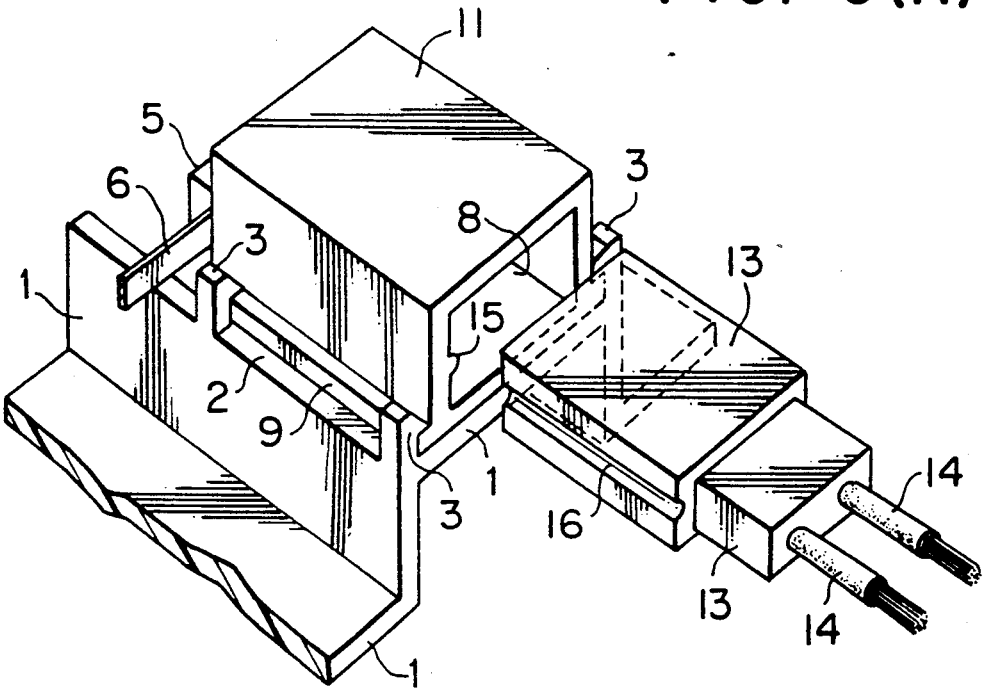
FIG. 3A is a perspective view of the state in which the cylinder has been attached to the insulating base and the male engaging member is facing the cylinder.
Figure 7A:
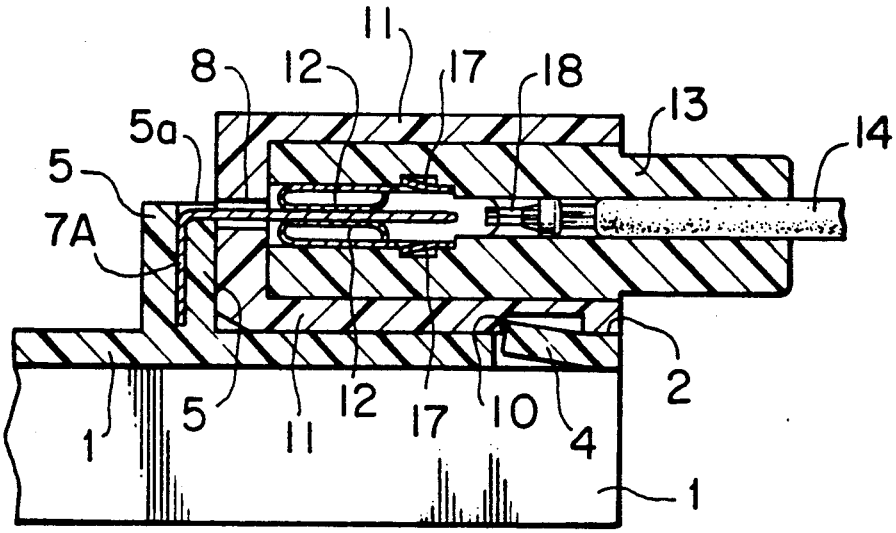
FIG. 7A is a longitudinal sectional side view of the state in which the male engaging member is engaged in the cylinder.
Figure 8A:
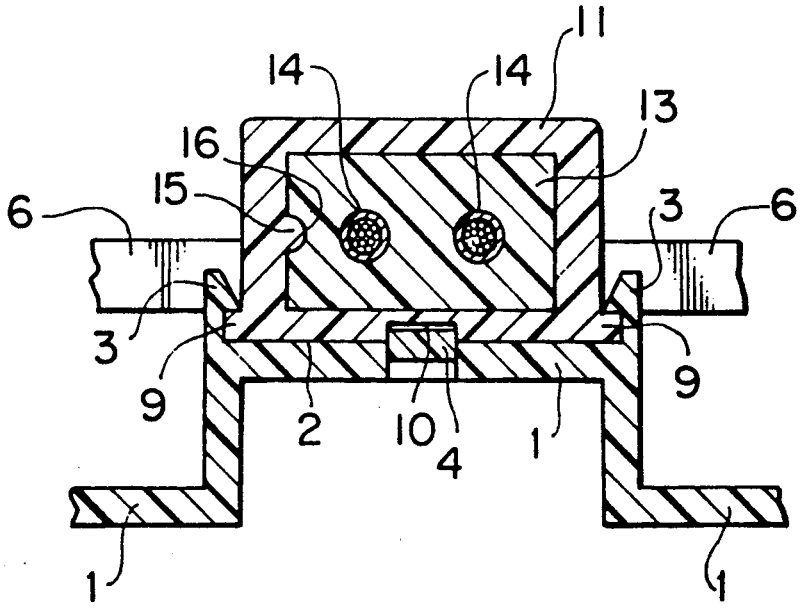
FIG. 8A is a vertical sectional view of the state indicated in FIG. 7A.

The electrical connector device of the present invention is then finally composed by comprising male engaging member 13 equipped with female connecting pieces 12 as indicated in FIG. 3A and FIG. 6A into which said bent pieces 7 are inserted as indicated in FIG. 6A, FIG. 7A and FIG. 8A within said cylinder 11.

Furthermore, numeral 17 in each of the drawings denotes locking tabs for locking female connecting pieces 12 within male engaging member 13 as indicated in FIG. 6A. Numeral 14 denotes lead wires having an insulative covering connected to female connecting pieces 12 by means of press fit connectors 18 as indicated in FIG. 6A and FIG. 7A. Numerals 15 and 16 denote convex and concave portions for restricting connection orientation which are formed on cylinder 11 and and male engaging member 13, respectively, as indicated in FIG. 3A. The dotted line indicated by numeral 6 in FIG. 1A denotes another narrow conducting strip such as a BUS bar embedded in base 1 including upper surface 2 of insulating base 1.

Moreover, cylinder 11 may in the shape of a tubular cylinder, and corresponding to this, male engaging member 13 may be in the shape of a hollow tube. In addition, the shape of the upper surface of insulating base 1 and the position at which locking projections 3 are formed should be determined accordingly.

In addition, although the previous explanation has been in regard to the example in which two each of narrow insulating strips 6 and bent pieces 7 were provided, 1 each or a plurality of 3 or more each may be arranged on insulating base 1. The number of female connecting pieces 12 as well as the shape of male engaging member 13 and cylinder 11 should then be selected corresponding to that quantity.

As the electrical connector device of the present invention comprises the above-mentioned composition, after inserting narrow conducting strips 6 from the separated state as indicated in FIG. 1A into slits 5*a* of projecting wall 5 as indicated in FIG. 2A, when side pieces 9 of cylinder 11 are pushed in between the hook portions of locking projections 3 from the right of insulating base 1 as indicated in FIG. 5A, resilient locking piece 4 becomes horizontal due to the force of the lower surface of cylinder 11 that is applied to the upper portion of the inclined surface of said resilient locking piece 4 in opposition to its resilient force. After becoming horizontal, the end surface of said resilient locking piece 4 engages in the manner of a clicking action with the inner surface of locking edge 10 of insulating base 1 due to the resilient force of said resilient locking piece 4 as indicated in FIG. 6A. Thus, cylinder 11 is able to be attached in the manner of a so-called "cassette locking" mechanism to insulating base 1 with a single locking action as indicated in FIG. 3A and FIG. 6A.

During this insertion, bases 7A of bent pieces 7 of narrow conducting strips 6 (BUS bars), which are arranged and fixed on insulating base 1, are inserted in slits 5*a* formed in projecting wall 5 of insulating base 1 as described above. As bases 7A are held in said projecting wall 5 in advance as indicated in FIG. 5A, insertion of cylinder 11 can be performed smoothly, making automatic mounting easy.

Thus, following the above-mentioned insertion, bent pieces 7 are neither deformed or displaced by the external force that results such as during insertion and removal of female connecting pieces 12 within cylinder 11 as is indicated in FIG. 7A and FIG. 8A.

Narrow conducting strips 6 can then be connected to an external circuit via bent pieces 7, female connecting pieces 12 and lead wires 14.

Figure 9A:
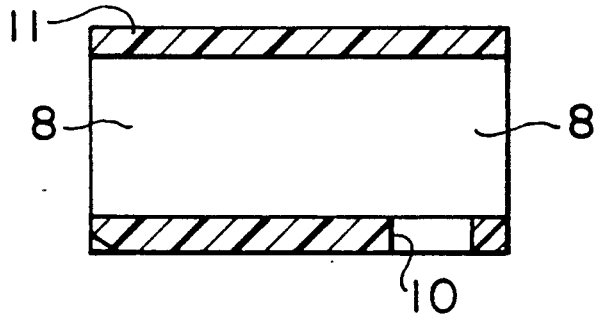
FIG. 9A is a longitudinal sectional view of the central portion of the cylinder indicated in FIG. 4A.

FIG. 4A and FIG. 9A are respectively, a perspective view and cross-sectional view of other embodiments of cylinder 11 of the present invention. In addition to utilizing the edge of a hole opened in the lower surface of cylinder 11 as the locking edge 10 of the embodiment indicated in above-mentioned FIG. 2A and FIG. 5A, grooves 9A are provided on the upper portion of side pieces 9 of cylinder 11.

In addition, the embodiments indicated in FIG. 10A through FIG. 13A indicate still other embodiments of the present invention.

Figure 10A:
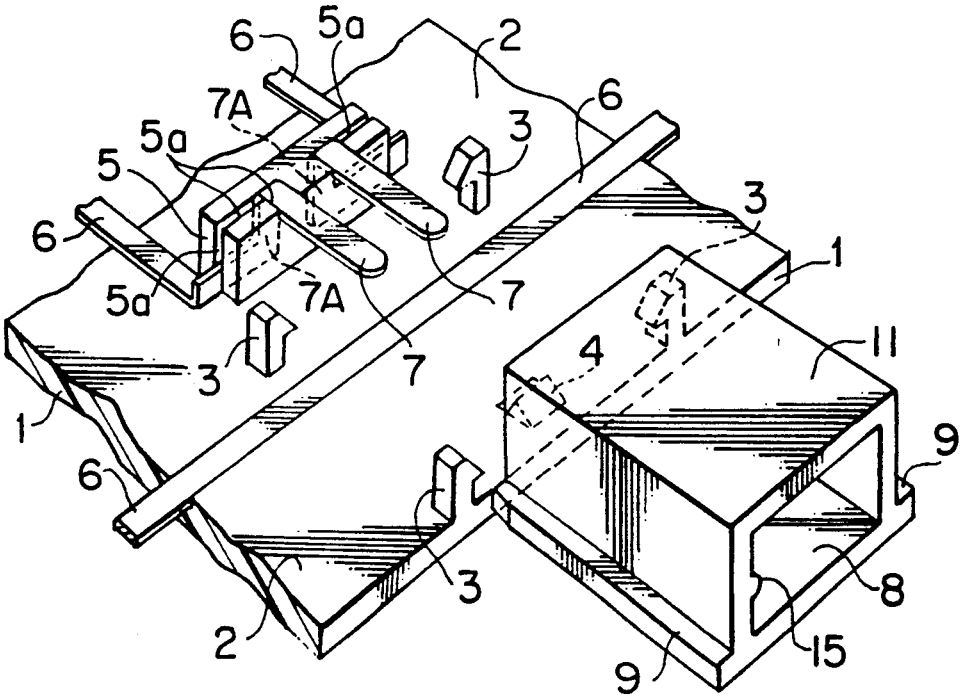
FIG. 10A is a perspective view of the cylinder and a flat insulating base.

Firstly, in the embodiment indicated in FIG. 10A, insulating base 1 is in the form of a flat plate. Together with narrow conducting strips 6 being bent flat and inserted into the narrow slits 5*a* of projecting wall 5 as indicated in this same figure, bases 7A of bent pieces 7 are inserted and supported in wide slits 5*a*.

Figure 11A:
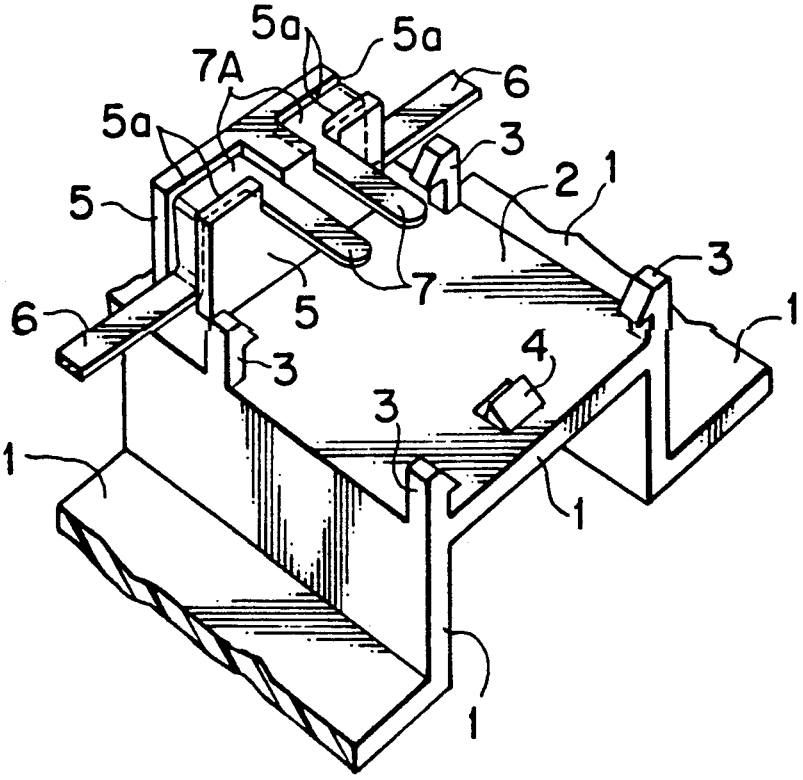
FIG. 11A, FIG. 12A and FIG. 13A are perspective views which indicate the essential portions of other embodiments of the narrow conducting strips and insulating bases, respectively.

Next, in the embodiment indicated in FIG. 11A, together with narrow conducting strips 6, which are arranged flat on insulating base 1, being bent and formed while still flat as indicated in this same figure, these flat narrow conducting strips 6 and bent bases 7A of bent pieces 7 are inserted and supported into wide, shallow slits 5*a* of projecting wall 5.

Figure 12A:
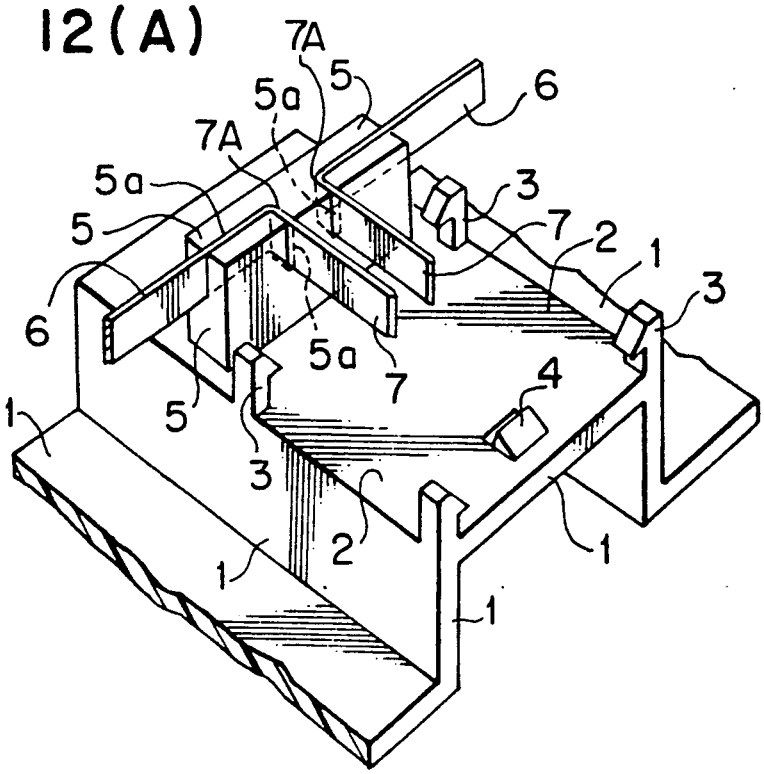

Moreover, in the embodiment indicated in FIG. 12A, together with a pair of opposing narrow conducting strips 6 being arranged upright with respect to the surface of insulating base 1, these upright narrow conducting strips 6 along with bases 7A of bent pieces 7 are inserted and supported in narrow slits 5*a*.

Figure 13A:
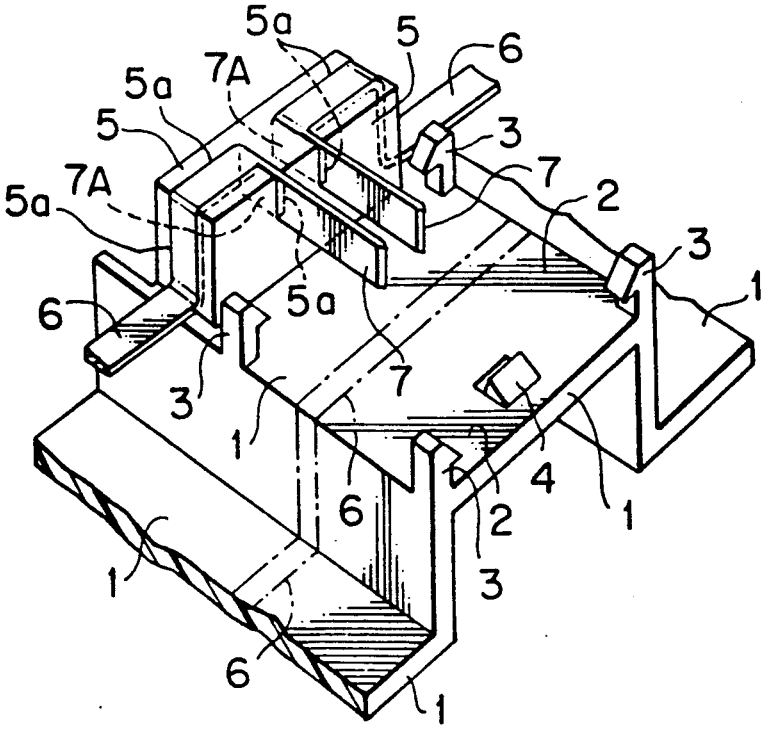

Finally, in the embodiment indicated in FIG. 13A, bent pieces 7 are made upright by bending narrow conducting strips 6, which are arranged flat on insulating base 1, in the manner indicated in this same figure. Together with bases 7A being supported with narrow slits 5*a*, narrow conducting strips 6 are inserted and supported in wide slits 5*a*.

Furthermore, in these other embodiments, those portions which have been denoted with the same numerals as the previously described basic embodiment denote the same portions as in the basic embodiment.

Moreover, if a gap is provided between the front portion of insulating base 1 and the lower surface of cylinder 11, cylinder 11 can be removed from insulating base 1 by pushing down on resilient locking piece 4 in opposition to its resilient force with a screwdriver or similar tool in front of that gap, thereby facilitating replacement during a failure.

Figure 5B:
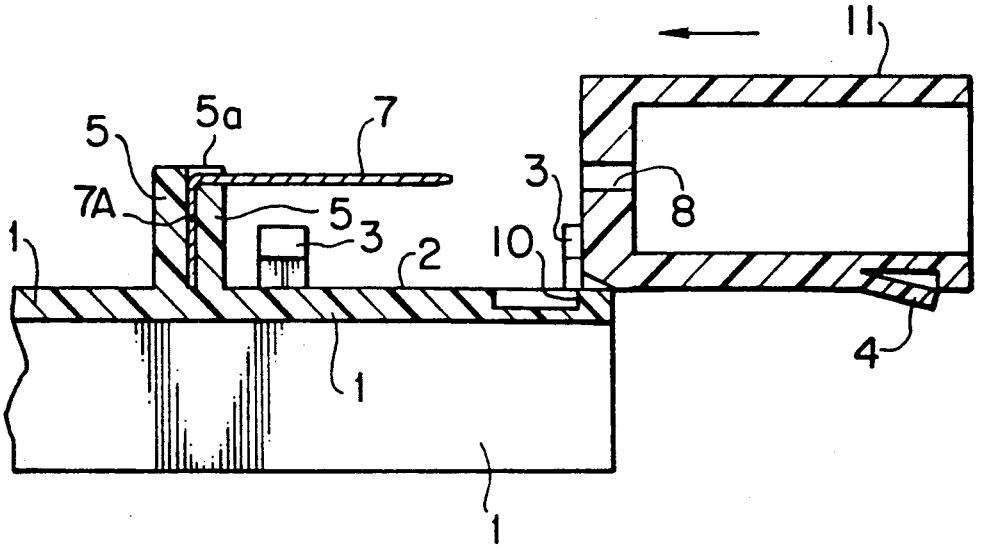
FIG. 5B is a longitudinal sectional side view of another embodiment.

In addition, FIG. 5B indicates an embodiment of the present invention in which locking edge 10 is provided on insulating base 1 and resilient locking piece 4 is provided on cylinder 11.

As will be understood from the foregoing description, the present invention offers the following advantages as a result of having the composition described above.

When side pieces 9 of cylinder 11 are pushed in between locking projections 3 from the front of insulating base 1, resilient locking piece 4 becomes horizontal due to the force of the lower surface of cylinder 11 that is applied to the upper portion of the inclined surface of said resilient locking piece 4 in opposition to its resilient force. After becoming horizontal, the end surface of said resilient locking piece 4 engages in the manner of a clicking action with the inner surface of locking edge 10 of insulating base 1 due to the resilient force of said resilient locking piece 4. Thus, cylinder 11 is able to be attached in the manner of a so-called "cassette locking" mechanism to insulating base 1 with a single locking action.

During the course of this insertion, as narrow conducting strips 6 and bent bases 7A are inserted and supported in slits 5*a* of projecting wall 5, automatic mounting can be performed easily and assembly yield is satisfactory, thus resulting in the first effect of the present invention.

In addition, as work such as the insertion of screws is not required during the course of the above-mentioned insertion, special tools such as a screwdriver are not necessary. Moreover, since other members for securing the cylinder such as a cover plate are also not necessary, ease of manipulation is improved and mounting can be performed by feeling with the hands in dark or confined locations therefore leading to advantages in terms of costs, thus resulting in the second effect of the present invention.

In addition, in the present invention in particular, together with being able to protect the upper portion of another BUS bar embedded in surface 2 of insulating base 1 as a result of being covered with the cylinder, as bases 7A of bent pieces 7 of the above-mentioned narrow conducting strips 6 (BUS bars) are inserted into slits 5*a* formed in projecting wall 5 of insulating base 1 and are held by said projecting wall 5, bent pieces 7 can be easily inserted and removed from female connecting pieces 12. Moreover, there is no deformation of displacement of bent pieces 7 resulting from external force such as that resulting from insertion and removal. In addition, since bent pieces 7 are further securely supported and fixed by insertion into female connecting pieces 12, the electrical connection state can be favorably maintained for a long period of time, thus resulting in the third effect of the present invention.

The following provides an explanation of a second embodiment of the present invention.

A second embodiment of the present invention will be described with reference to the drawings.

Figure 1B:
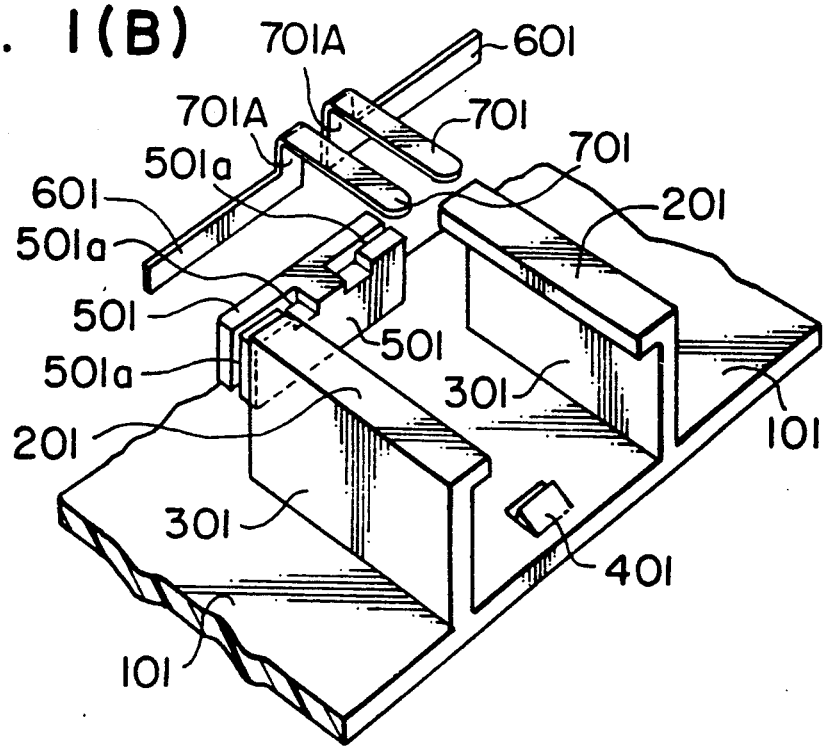
FIG. 1B is a perspective view of the state in which the insulating base and narrow conducting strips are separated.

Firstly, the basic composition of the present invention consists of two guide walls 301 having opposing pieces 201 on their upper portions, and at least one resilient locking piece 401 formed on the surface of insulating base 101 made of plastic as indicated in FIG. 1B.

Figure 2B:
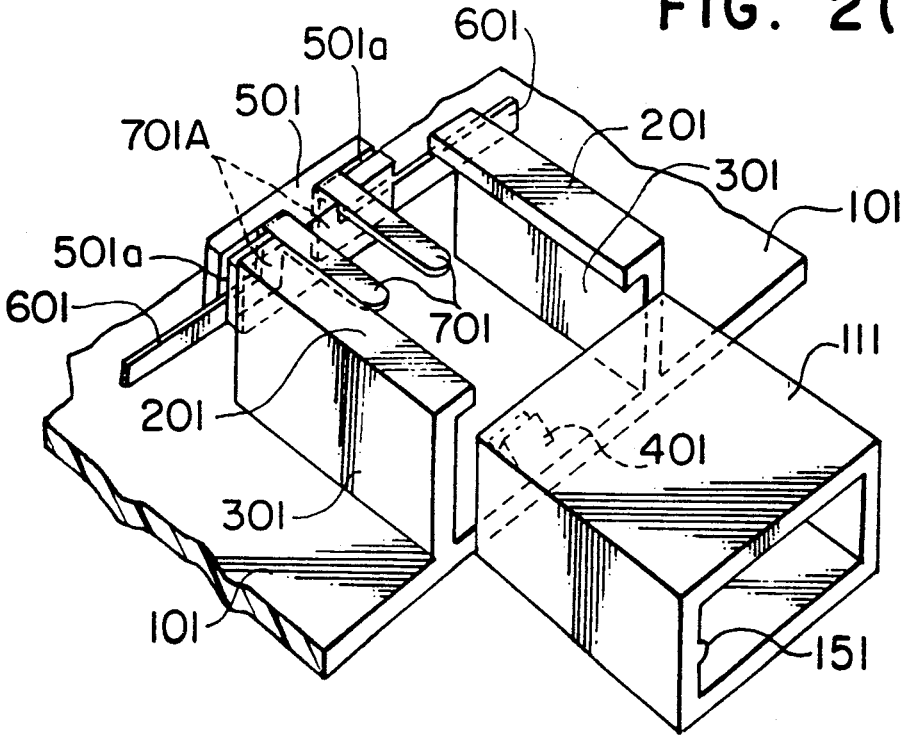
FIG. 2B is a perspective view of the state in which the narrow conducting strips are attached to the insulating base and the cylinder is facing the insulating base.

Bent pieces 701 are provided by being formed and bent nearly in parallel on, for example, the ends of narrow conducting strips 601 in the shape of narrow metal bands as indicated in FIG. 1B, which are used by inserting and fixing in slits 501*a* provided in the longitudinal direction in projecting wall 501 provided in an integrated manner on the upper surface of said insulating base 101 as indicated in FIG. 2B.

Figure 5C:
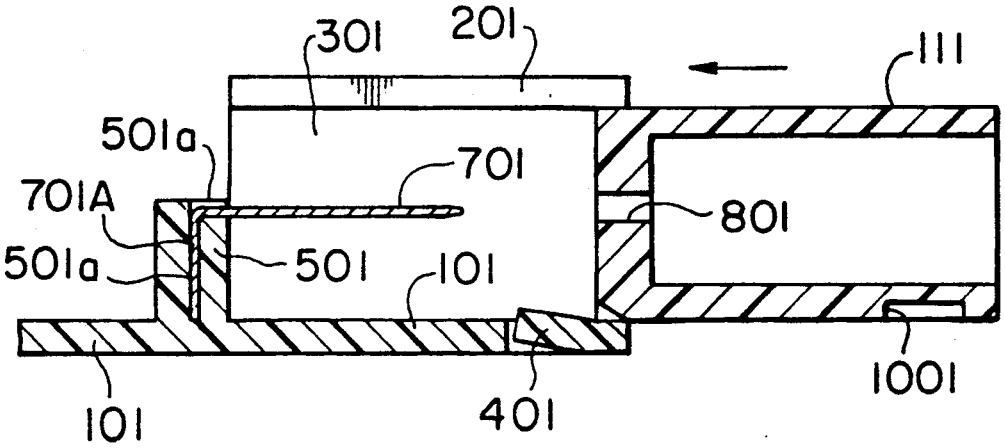
FIG. 5C is a longitudinal sectional side view of the embodiment indicated in FIG. 2B.

In addition, bases 701A of said bent pieces 701 are inserted in the manner described above into slits 501*a* of said projecting wall 501 and held as indicated in FIG. 2B and FIG. 5C.

Figure 6B:
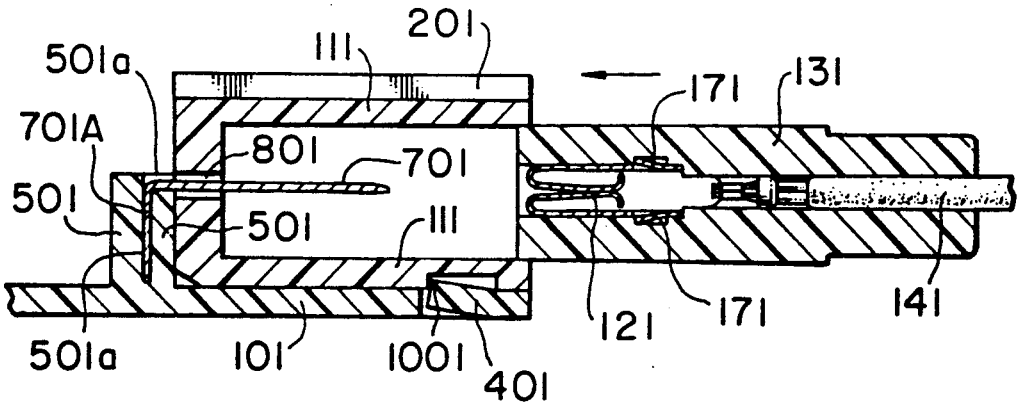
FIG. 6B is a longitudinal sectional side view of the embodiment indicated in FIG. 3B.

Moreover, opening 801, through which said bent pieces 701 pass as shown in FIG. 5C, is formed in cylinder 111 made of heat-resistant plastic such as Nylon 66 possessing insulating properties, which is attached and locks into position on said insulating base 101 as indicated in FIG. 6B via the state indicated in FIG. 5C by means of resilient locking piece 401 through locking edge 1001 between said guide walls 301 as indicated in FIG. 1B

Figure 3B:
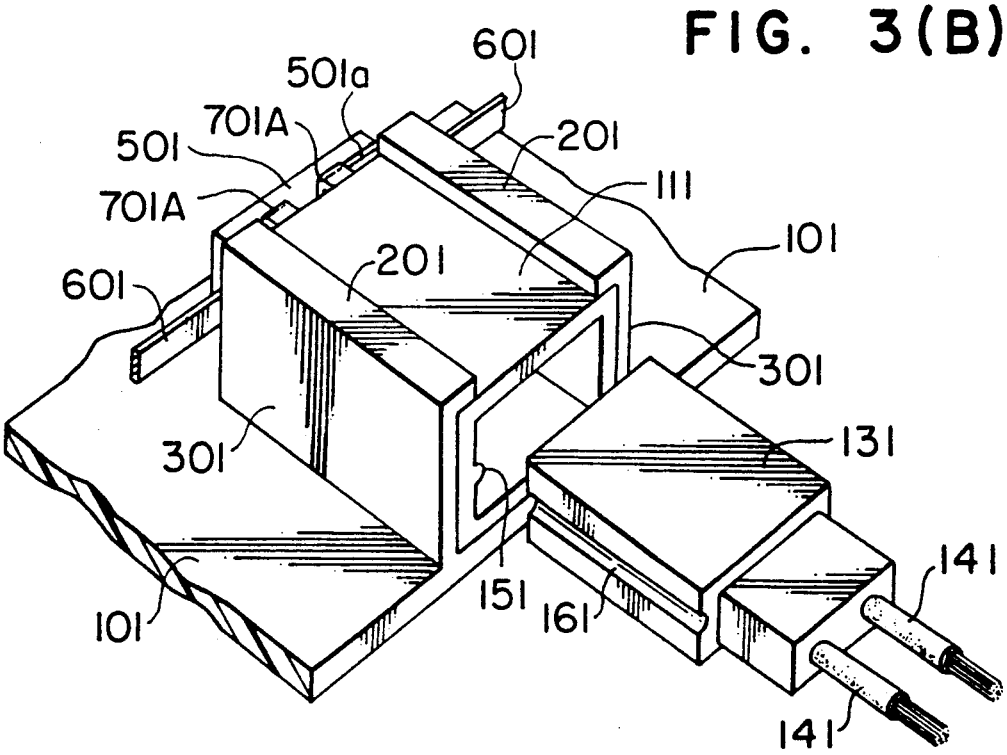
FIG. 3B is a perspective view of the state in which the cylinder has been attached to the insulating base and the male engaging member is facing the cylinder.
Figure 7B:
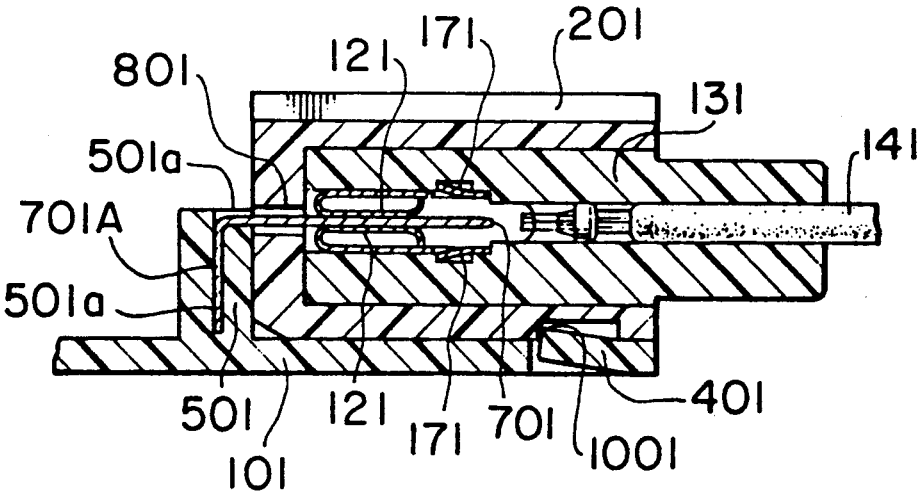
FIG. 7B is a longitudinal sectional side view of the state in which the male engaging member is engaged in the cylinder.
Figure 8B:
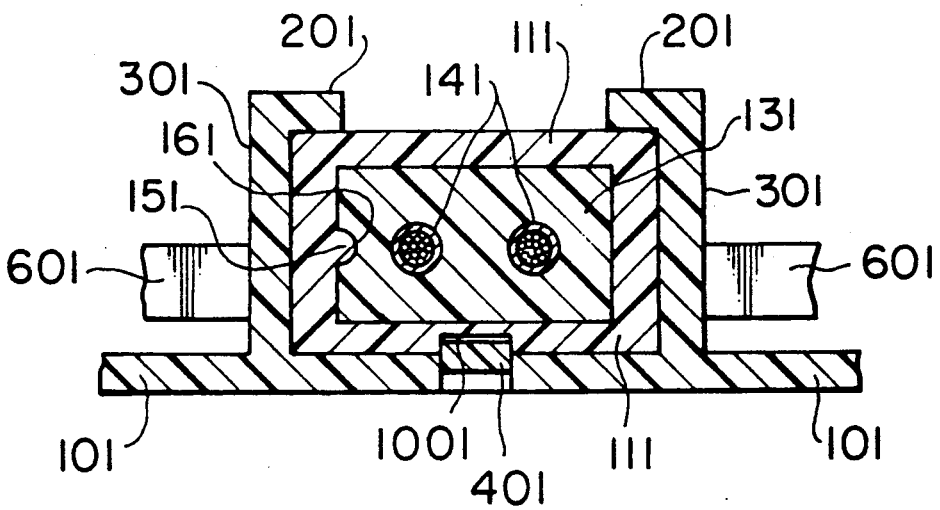
FIG. 8B is a vertical sectional view of the state indicated in FIG. 7B.

The electrical connector device of the present invention is then finally composed by comprising male engaging member 131 equipped with female connecting pieces 121 as indicated in FIG. 3B and FIG. 6B into which said bent pieces 701 are inserted as indicated in FIG. 6B, FIG. 7B and FIG. 8B within said cylinder 111.

Furthermore, numeral 171 in each of the drawings denotes locking tabs for locking female connecting pieces 121 within male engaging member 131 as indicated in FIG. 6B. Numeral 141 denotes lead wires having an insulative covering connected to female connecting pieces 121 by means of press fit connectors 181 as indicated in FIG. 6B and FIG. 7B. Numerals 151 and 161 denote convex and concave portions for restricting connection orientation which are formed on cylinder 111 and and male engaging member 131, respectively, as indicated in FIG. 3B.

Moreover, cylinder 111 may in the shape of a tubular cylinder, and corresponding to this, male engaging member 131 may be in the shape of a hollow tube. In addition, the shape of the upper surface of insulating base 101 and the position at which guide walls 301 are formed should be determined accordingly.

In addition, although the previous explanation has been in regard to the example in which two each of narrow insulating strips 601 and bent pieces 701 were provided, 1 each or a plurality of 3 or more each may be arranged on insulating base 101. The number of female connecting pieces 121 as well as the shape of male engaging member 131 and cylinder 111 should then be selected corresponding to that quantity.

As the electrical connector device of the present invention comprises the above-mentioned composition, after inserting narrow conducting strips 601 from the separated state as indicated in FIG. 1B into slits 501*a* of projecting wall 501 as indicated in FIG. 2B, when cylinder 111 is pushed in between the lower edges of opposing pieces 201 on the upper portions of guide walls 301 from the right of insulating base 101 as indicated in FIG. 5C, resilient locking piece 401 becomes horizontal due to the force of the lower surface of cylinder 111 that is applied to the upper portion of the inclined surface of said resilient locking piece 401 in opposition to its resilient force. After becoming horizontal, the end surface of said resilient locking piece 401 engages in the manner of a clicking action with the inner surface of locking edge 1001 of insulating base 101 due to the resilient force of said resilient locking piece 401 as indicated in FIG. 6B. Thus, cylinder 111 is able to be attached in the manner of a so-called "cassette locking" mechanism to insulating base 101 with a single locking action as indicated in FIG. 3B and FIG. 6B.

During this insertion, bases 701A of bent pieces 701 of narrow conducting strips 601 (BUS bars), which are arranged and fixed on insulating base 101, are inserted in advance in slits 501*a* formed in projecting wall 501 of insulating base 101 as described above. As bases 701A are held in said projecting wall 501 as indicated in FIG. 5C, insertion of cylinder 111 can be performed smoothly, making automatic mounting easy.

Thus, following the above-mentioned insertion, bent pieces 701 are neither deformed or displaced by the external force that results such as during insertion and removal of female connecting pieces 121 within cylinder 111 as is indicated in FIG. 7B and FIG. 8B.

Narrow conducting strips 601 can then be connected to an external circuit via bent pieces 701, female connecting pieces 121 and lead wires 141.

Figure 9B:
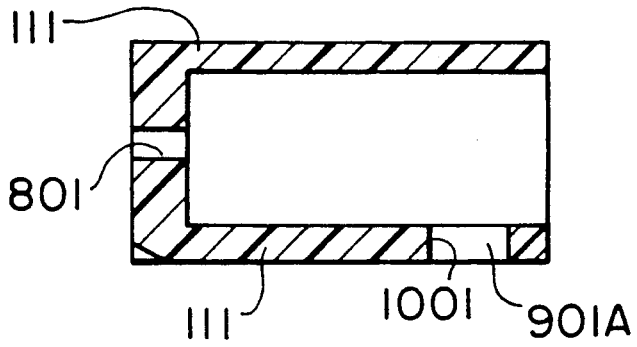
FIG. 9B is a longitudinal sectional view of the central portion of the cylinder indicated in FIG. 4B.
Figure 9C:
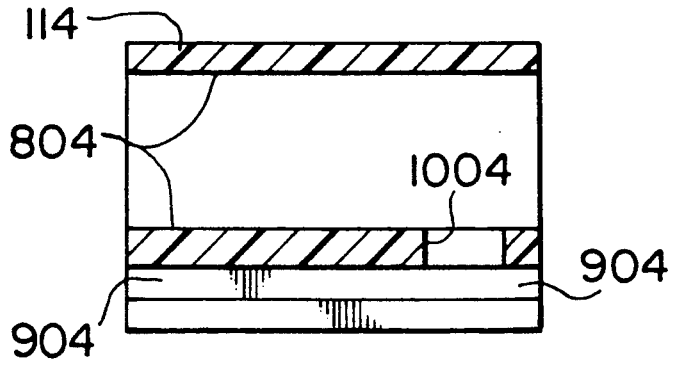
FIG. 9C is a longitudinal sectional view of the central portion of the cylinder indicated in FIG. 4C.

FIG. 4B and FIG. 9B are respectively, a perspective view and cross-sectional view of other embodiments of cylinder 111 of the present invention. In addition to utilizing the edge of a hole opened in the lower surface of cylinder 111 as the locking edge 1001 of the embodiment indicated in above-mentioned FIG. 2B and FIG. 5C, hole 901A is provided in the bottom portion of cylinder 111.

In addition, the embodiments indicated in FIG. 10B through FIG. 13B indicate still other embodiments of the present invention.

Figure 10B:
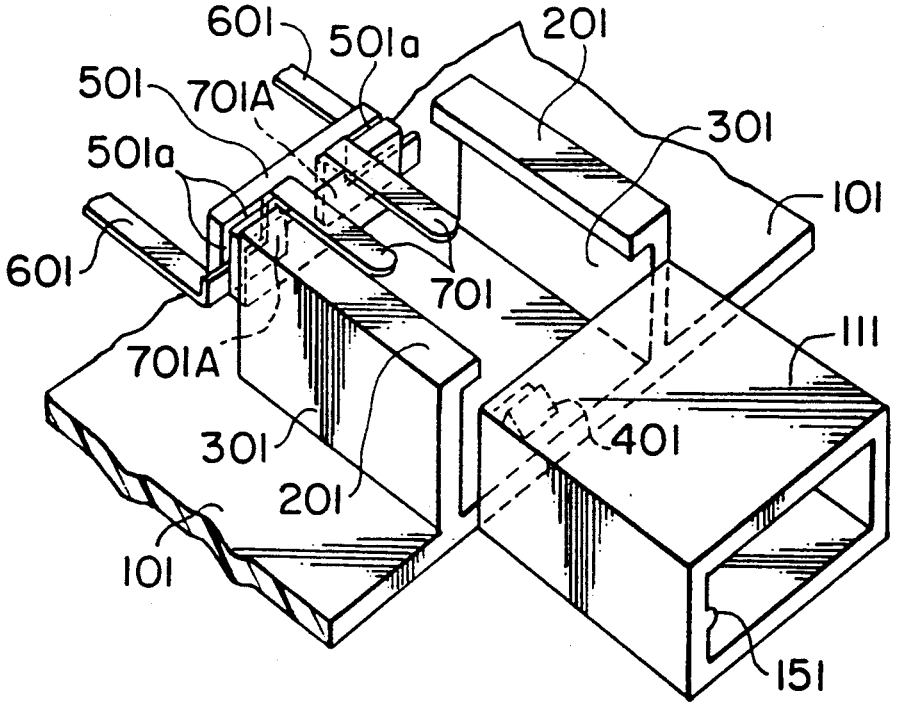
FIG. 10B is a perspective view of the cylinder and a flat insulting base.

Firstly, in the embodiment indicated in FIG. 10B, insulating base 101 is in the form of a flat plate. Together with narrow conducting strips 601 being bent flat and inserted into the narrow slits 501*a* of projecting wall 501 as indicated in this same figure, bases 701A of bent pieces 701 are inserted and supported in wide slits 501*a*.

Figure 11B:
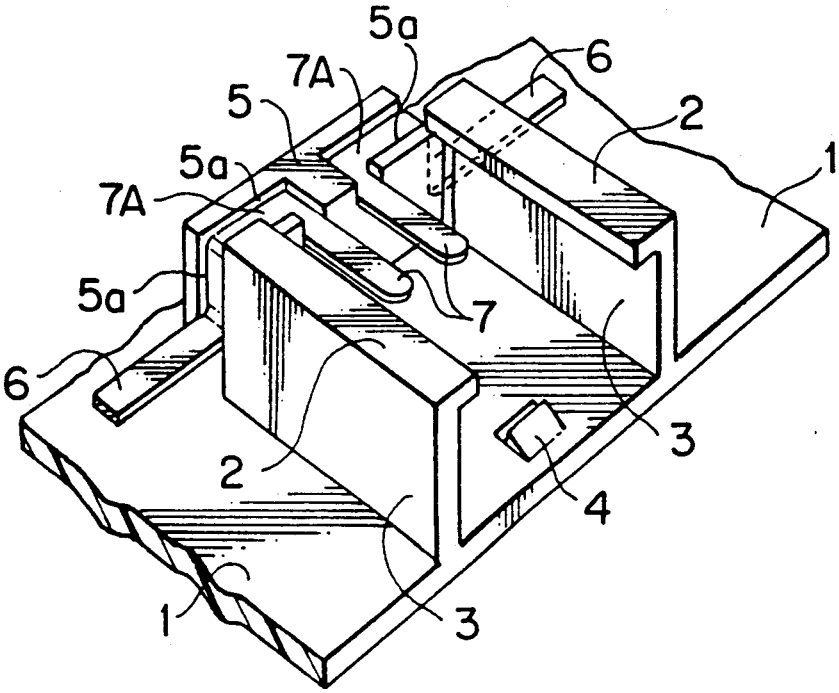
FIG. 11B, FIG. 12B and FIG. 13B are perspective views which indicate the essential portions of other embodiments of the narrow conducting strips and insulating bases, respectively.

Next, in the embodiment indicated in FIG. 11B, together with narrow conducting strips 601, which are arranged flat on insulating base 101, being bent and formed while still flat as indicated in this same figure, these flat narrow conducting strips 601 and bent bases 701A of bent pieces 701 are inserted and supported into wide, shallow slits 501*a* of projecting wall 501.

Figure 12B:
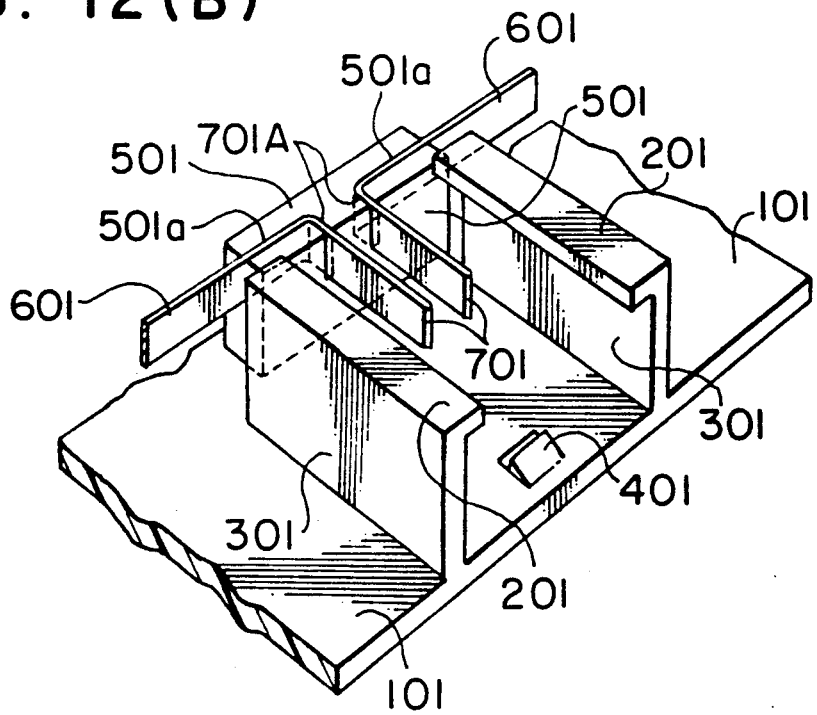

Moreover, in the embodiment indicated in FIG. 12B, together with a pair of opposing narrow conducting strips 601 being arranged upright with respect to the surface of insulating base 101, these upright narrow conducting strips 601 along with bases 701A of bent pieces 701 are inserted and supported in narrow slits 501*a*.

Figure 13B:
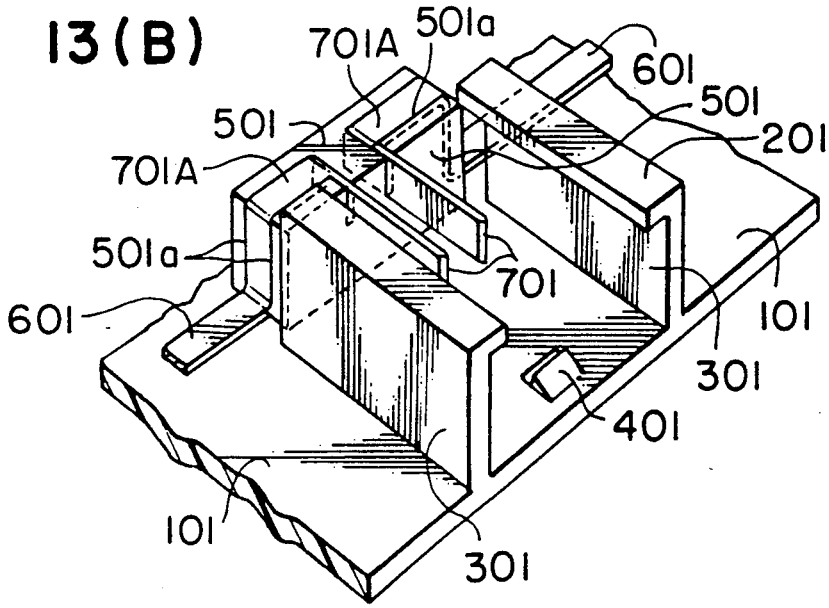

Finally, in the embodiment indicated in FIG. 13B, bent pieces 701 are made upright by bending narrow conducting strips 601, which are arranged flat on insulating base 101, in the manner indicated in this same figure. Together with bases 701A being supported with narrow slits 501*a*, narrow conducting strips 601 are inserted and supported in wide slits 501*a*.

Furthermore, in these other embodiments, those portions which have been denoted with the same numerals as the previously described basic embodiment denote the same portions as in the basic embodiment.

Moreover, if a gap is provided between the front portion of insulating base 101 and the lower surface of cylinder 111, cylinder 111 can be removed from insulating base 101 by pushing down on resilient locking piece 401 in opposition to its resilient force with a screwdriver or similar tool in front of that gap, thereby facilitating replacement during a failure.

Figure 5D:
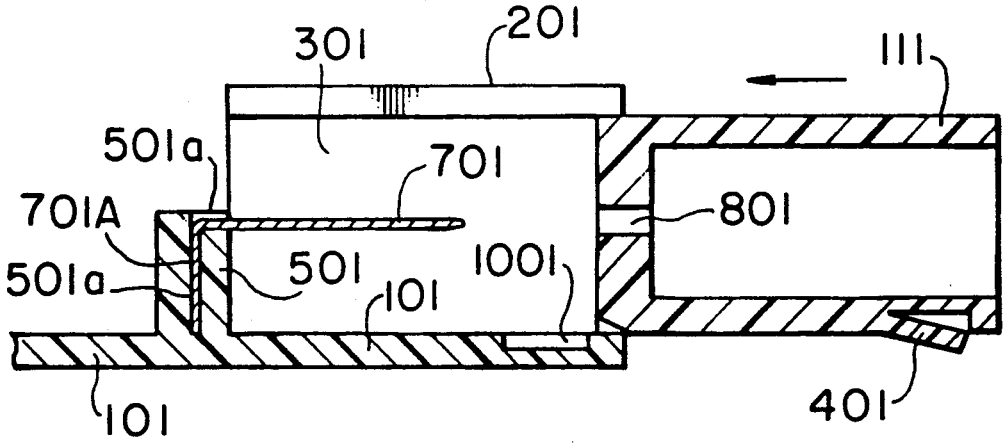
FIG. 5D is a longitudinal sectional side view of another embodiment.

In addition, FIG. 5D indicates an embodiment of the present invention in which locking edge 10 is provided on insulating base 1 and resilient locking piece 4 is provided on cylinder 11.

The following provides an explanation of a third embodiment of the present invention.

By inserting the bases of bent pieces of narrow conducting strips (BUS bars) arranged and fixed on an insulating base into slits formed in a projecting wall on that insulating base, the bent pieces are able to be held in the projecting wall by their bases. This prevents the bent pieces from being deformed or displayed by an external force such as that resulting from being attached and removed from the female connecting pieces.

When a cylinder is pushed onto the front of an insulating base by aligning grooves of the cylinder with rail edges of the insulating base, the gap between a resilient locking piece of the cylinder and the cylinder is narrowed by the force applied to the inclined surface on the bottom side of said resilient locking piece by the projecting edge of the above-mentioned insulating base in opposition to the resilient force of said resilient locking piece. After this gap is narrowed, the end of the resilient locking piece engages in the manner of a clicking action with the inner surface of the projecting edge of the insulating base as a result of the cylinder continuing to be pushed onto the insulating base. Thus, the cylinder is able to be attached to the insulating base in the manner of a so-called "cassette locking" mechanism with a single locking action.

In particular, during this mounting, as the bent pieces of the BUS bars are held in advance in the slits of the projecting wall by their bases as stated above, automatic mounting becomes easy.

In addition, the bent pieces are further securely supported and secured as a result of being inserted in female connecting pieces.

The following provides an explanation of a third embodiment of the present invention with reference to the drawings.

Figure 14:
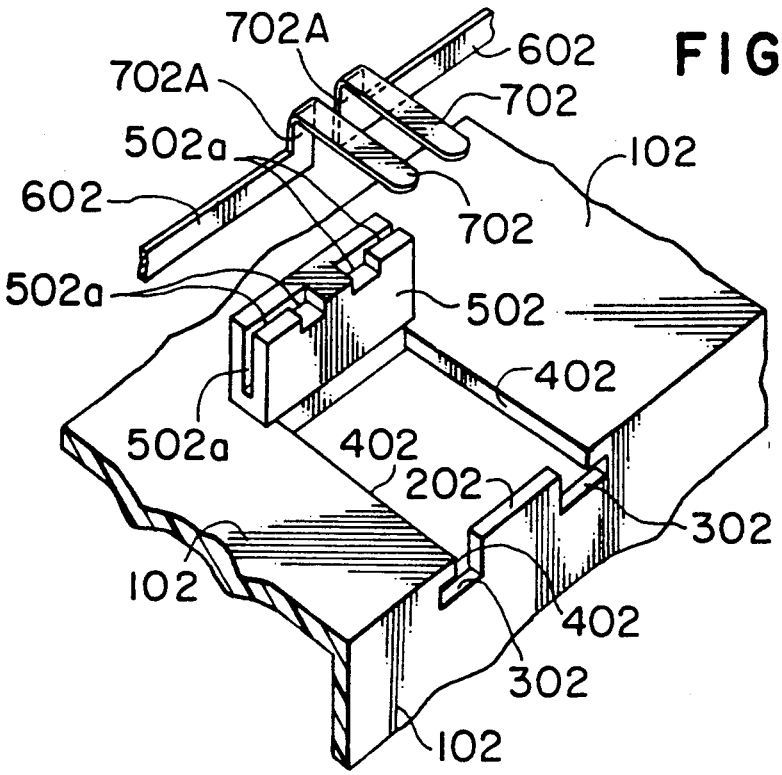
FIG. 14 is a perspective view of the state in which the insulating base and narrow conducting strips are separated.
Figure 15:
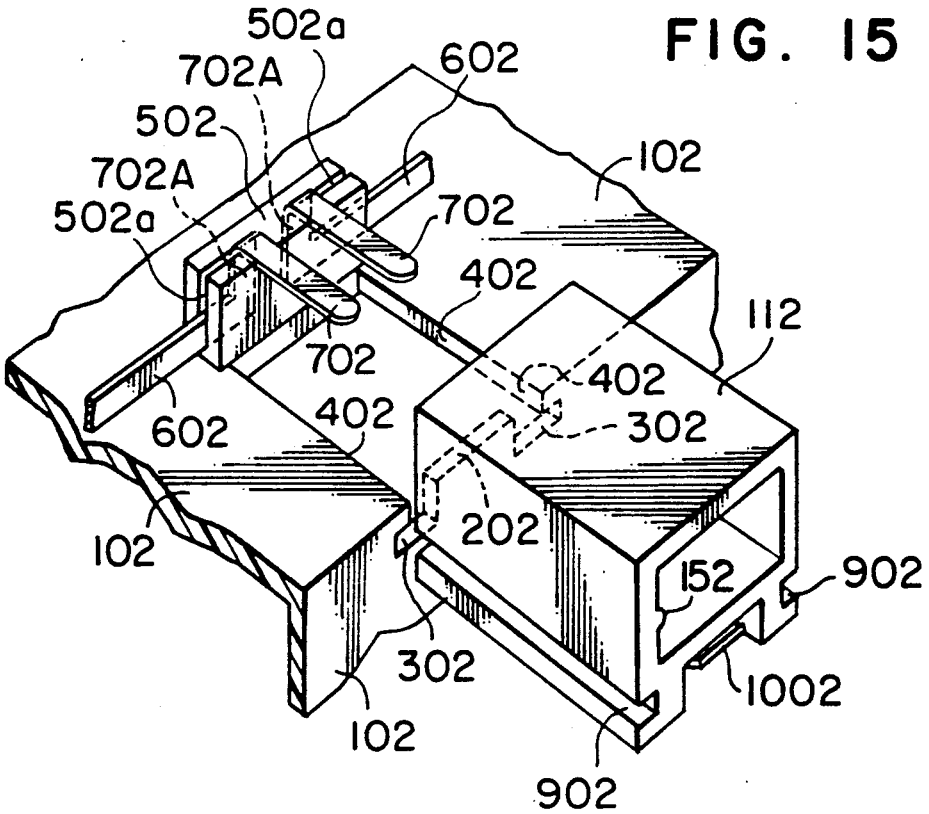
FIG. 15 is a perspective view of the state in which the narrow conducting strips are attached to the insulating base and the cylinder is facing the insulating base.

Firstly, the basic composition of the present invention consists of a pair of rail edges 402 formed in combination with the upper portions of a pair of notches 302 provided on both sides of projecting edge 202 of insulating base 102 which is formed such that the cross-section is nearly in the shape of an "L" as indicated in FIG. 14 and FIG. 15.

Narrow bent pieces 702 are provided partially inserted into slits 502*a* along one surface of projecting wall 502 provided in an integrated manner on a surface of insulating base 102 near each of the ends of each rail edges 402, and are formed nearly parallel in between said rail edges 402 on the end portions of, for example, narrow conducting strips 602 in the shape of narrow metal bands arranged on said insulating base 102.

Figure 16:
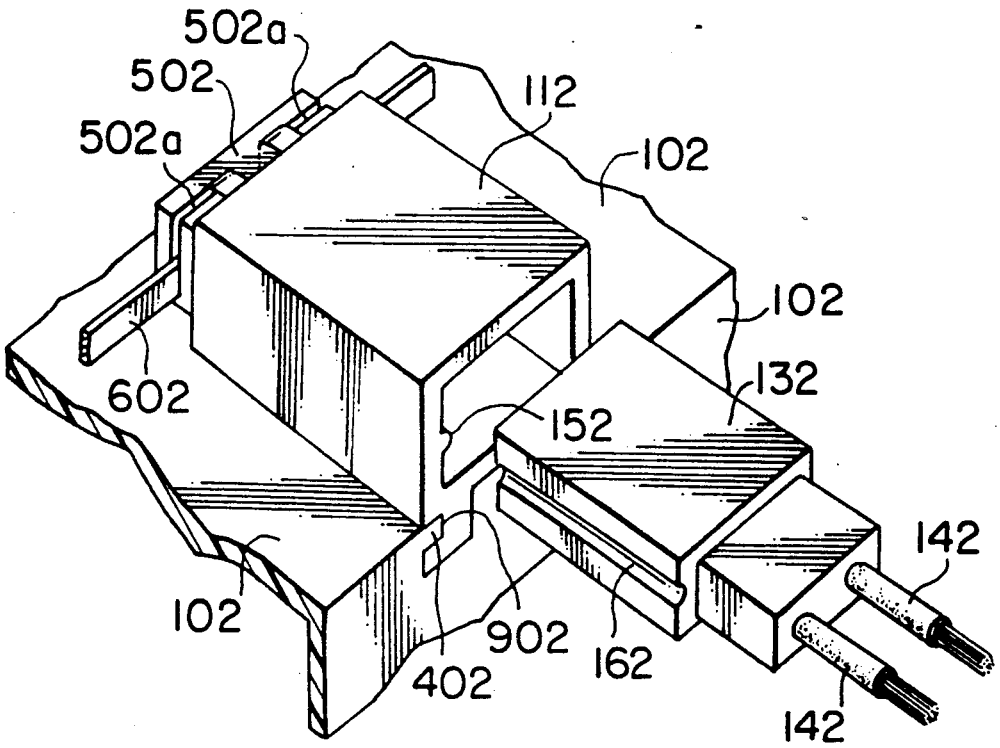
FIG. 16 is a perspective view of the state in which the cylinder has been attached to the insulating base and the male engaging member is facing the cylinder.
Figure 17:
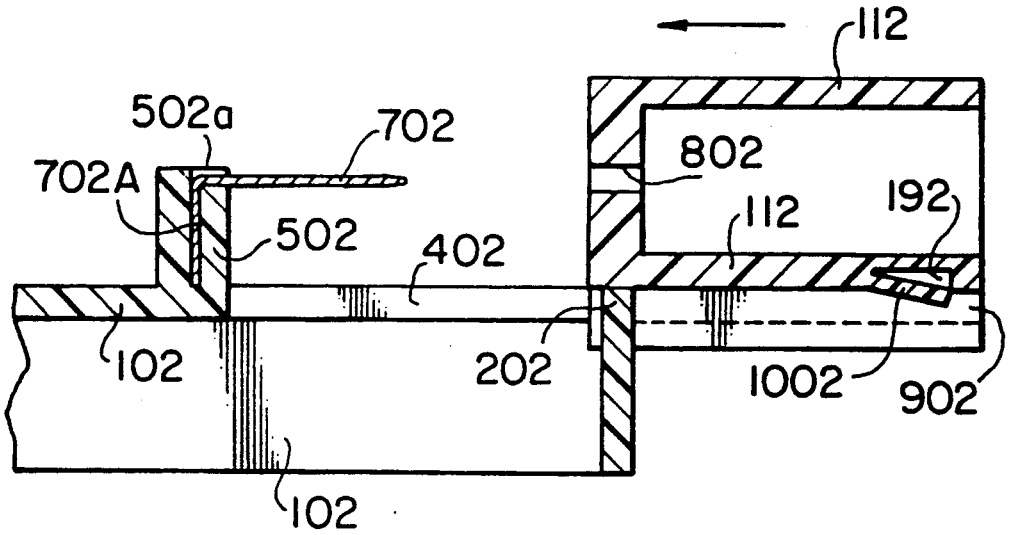
FIG. 17 is a longitudinal sectional side view of the embodiment indicated in FIG. 15.
Figure 18:
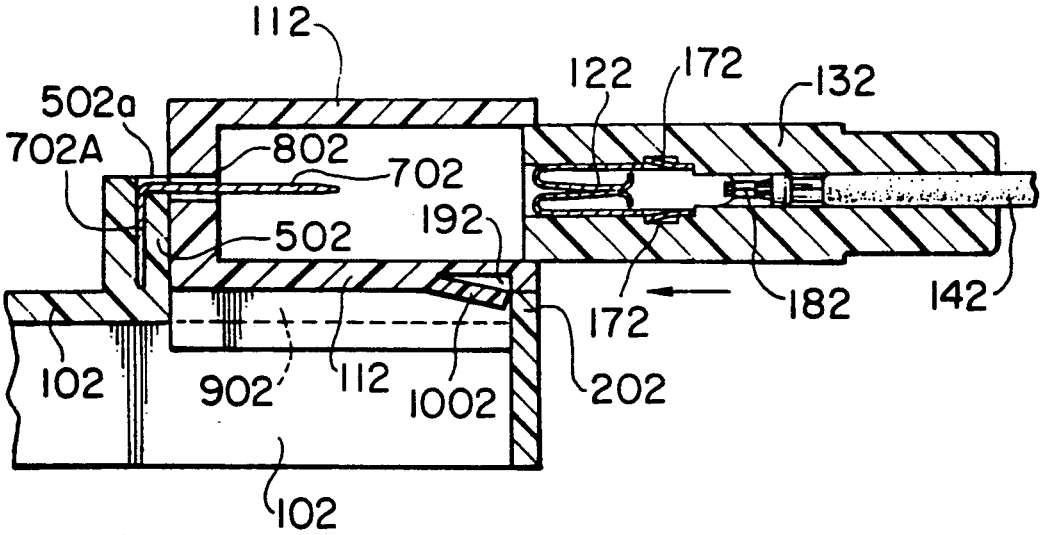
FIG. 18 is a longitudinal sectional side view of the embodiment indicated in FIG. 16.

Moreover, opening 802, through which said bent pieces 702 pass as shown in FIG. 17, and grooves 902, which engage with said rail edges 402, are respectively formed as indicated in FIG. 15 in cylinder 112 made of heat-resistant plastic such as Nylon 66 possessing insulating properties, which is attached to said insulating base 102 as indicated in FIG. 16 and FIG. 18 by means of resilient locking piece 1002 as indicated in FIG. 15 and FIG. 17 locking onto said projecting edge 202 as indicated in FIG. 18.

Figure 25:
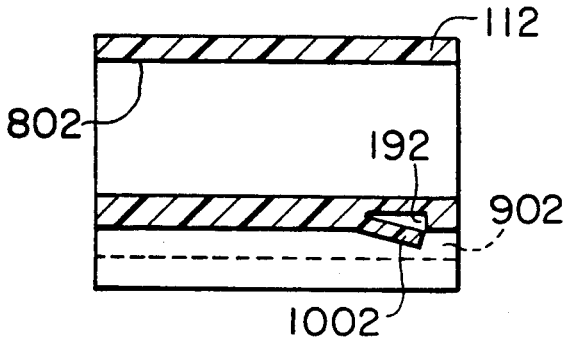
FIG. 25 is a longitudinal sectional side view indicating another embodiment of the cylinder.

Furthermore, cylinder 112 may also be that in which a larger opening 802 is formed as indicated in FIG. 25.

Figure 19:
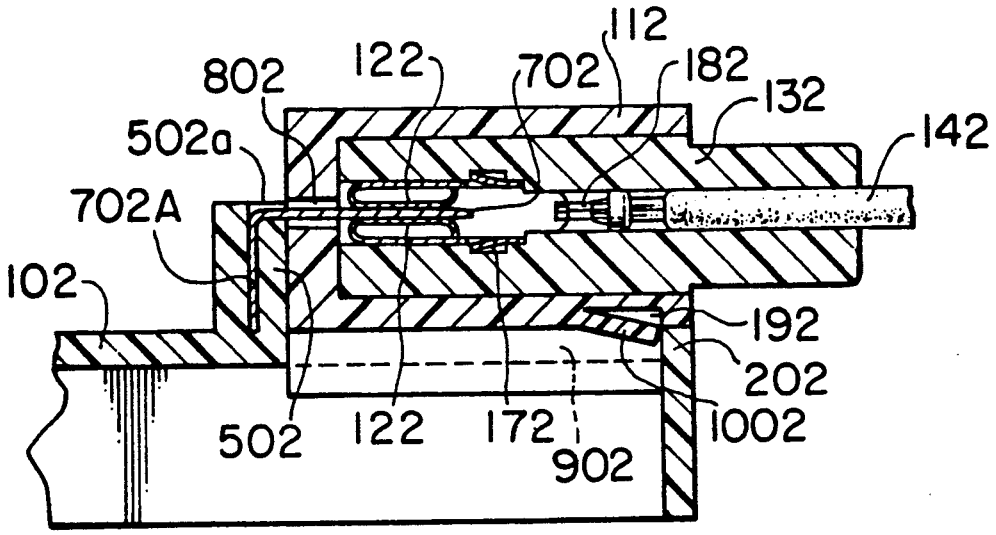
FIG. 19 is a longitudinal sectional side view of the state in which the male engaging member is engaged in the cylinder.

The electrical connector device of the present invention is then finally composed by comprising male engaging member 132 equipped with female connecting pieces 122 as indicated in FIG. 16 and FIG. 18 into which said bent pieces 702 are inserted as indicated in FIG. 19 within said cylinder 112, together with bases 702A of said bent pieces 702 being held in slits 502*a* of said projecting wall 502 as indicated in FIG. 15 and FIG. 17.

Figure 20:
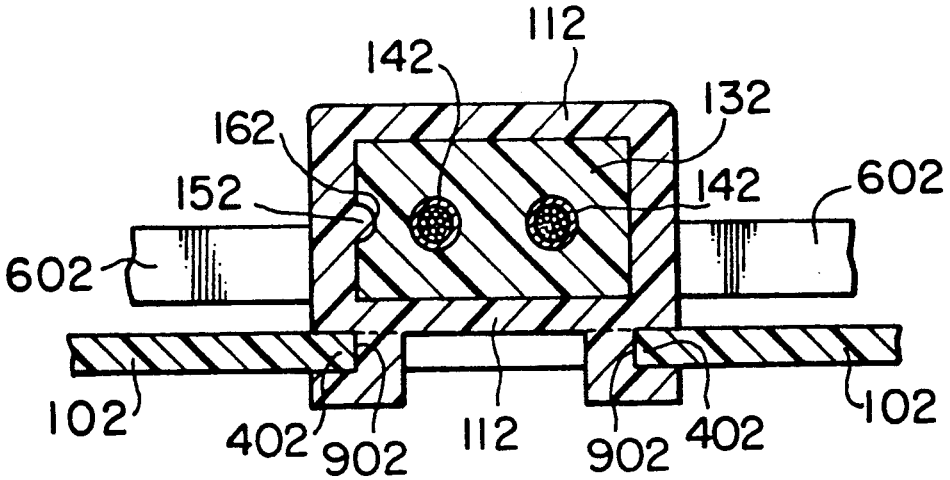
FIG. 20 is a vertical sectional view of the state indicated in FIG. 19.

Furthermore, numeral 172 in each of the drawings denotes locking tabs for locking female connecting pieces 122 within male engaging member 132 as indicated in FIG. 18. Numeral 142 denotes lead wires having an insulative covering connected to female connecting pieces 122 by means of press fit connectors 182 as indicated in FIG. 18, FIG. 19 and FIG. 20 Numerals 152 and 162 denote convex and concave portions for restricting connection orientation which are formed on cylinder 112 and and male engaging member 132, respectively, as indicated in FIG. 14.

Moreover, cylinder 112 may be in the shape of a tubular cylinder, and corresponding to this, male engaging member 132 may be in the shape of a hollow tube.

In addition, although the previous explanation has been in regard to the example in which two each of narrow insulating strips 602 and bent pieces 702 were provided, 1 each or a plurality of 3 or more each may be arranged on insulating base 102. The number of female connecting pieces 122 as well as the shape of male engaging member 132 and cylinder 112 should then be selected corresponding to that quantity.

As the electrical connector device of the present invention comprises the above-mentioned composition, when grooves 902 of cylinder 112 are pushed onto rail edges 402 in combination with notches 302 from the front of insulating base 102 as indicated in FIG. 15 and FIG. 17, the gap between resilient locking piece 1002 and insulating base 102 is narrowed due to the force of projecting edge 202 of said notches 302 that is applied to the inclined surface of the bottom side of said resilient locking piece 1002 in opposition to its resilient force. After narrowing, the end surface of said resilient locking piece 1002 engages in the manner of a clicking action with the inner surface of projecting edge 202 of insulating base 102 as a result of cylinder 112 continuing to be pushed onto insulating base 102 as indicated in FIG. 18. Thus, cylinder 112 is able to be attached in the manner of a so-called "cassette locking" mechanism to insulating base 102 with a single locking action as indicated in FIG. 16 and FIG. 18.

During this insertion, bases 702A of bent pieces 702 of narrow conducting strips 602 (BUS bars), which are arranged and fixed on insulating base 102, are inserted in slits 502*a* formed in projecting wall 502 of insulating base 102 as described above. As bases 702A are held in said projecting wall 502 in advance as indicated in FIG. 15 and FIG. 17, insertion of cylinder 112 can be performed smoothly, making automatic mounting easy.

Thus, following the above-mentioned insertion, bent pieces 702 are neither deformed or displaced by the external force that results such as during insertion and removal of female connecting pieces 122 within cylinder 112 as is indicated in FIG. 18 and FIG. 19.

Narrow conducting strips 602 can then be connected to an external circuit via bent pieces 702, female connecting pieces 122 and lead wires 142.

The embodiments indicated in FIG. 21 through FIG. 24 indicate still other embodiments of the present invention.

Figure 21:
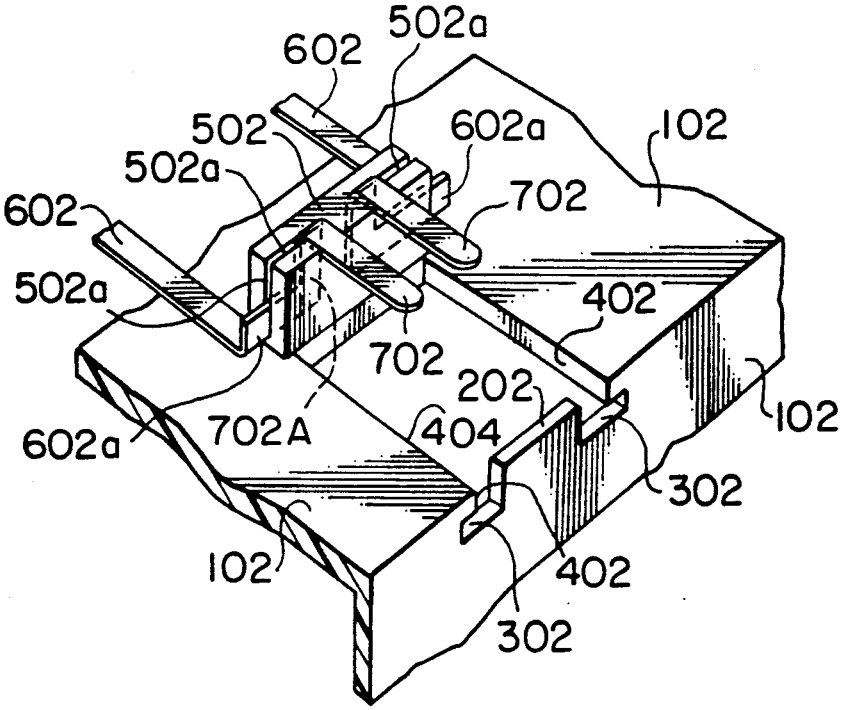
FIG. 21, FIG. 22, FIG. 23 and FIG. 24 are perspective views which indicate the essential portions of other embodiments of the narrow conducting strips and insulating bases, respectively.

Firstly, in the embodiment indicated in FIG. 21, the narrow conducting strips of the above-mentioned embodiment are bent and arranged flat along the surface of insulating base 102 as indicated in this same figure. In addition, upright portions 602*a* of narrow conducting strips 602 are inserted and supported in slits 502*a* of projecting wall 502.

Figure 22:
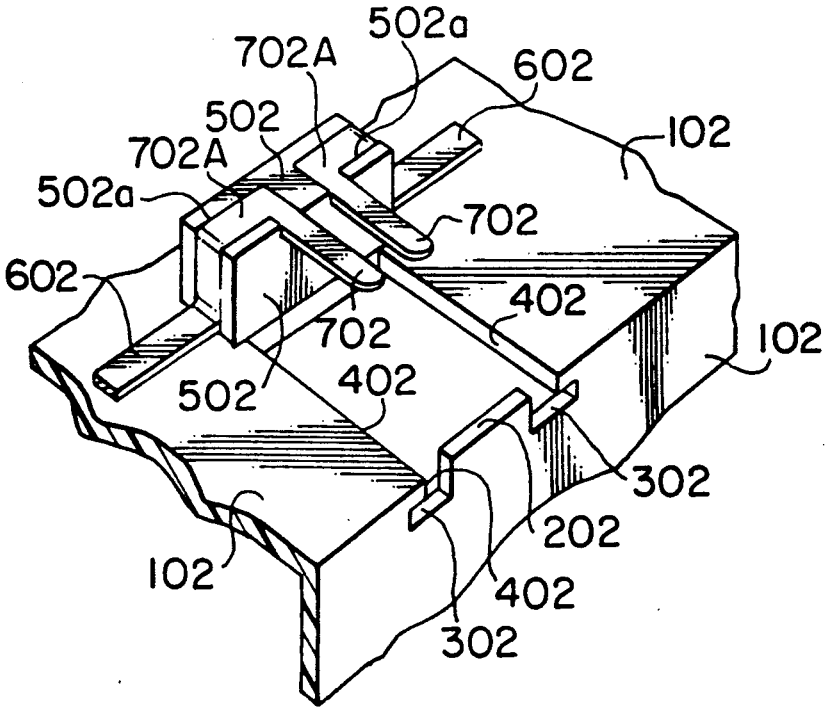

Next, in the embodiment indicated in FIG. 22, together with narrow conducting strips 602, which are arranged flat on insulating base 102, being bent and formed while still flat as indicated in this same figure, these flat narrow conducting strips 602 and bent bases 702A of bent pieces 702 are inserted and supported into wide, shallow slits 502*a* of projecting wall 502.

Figure 23:
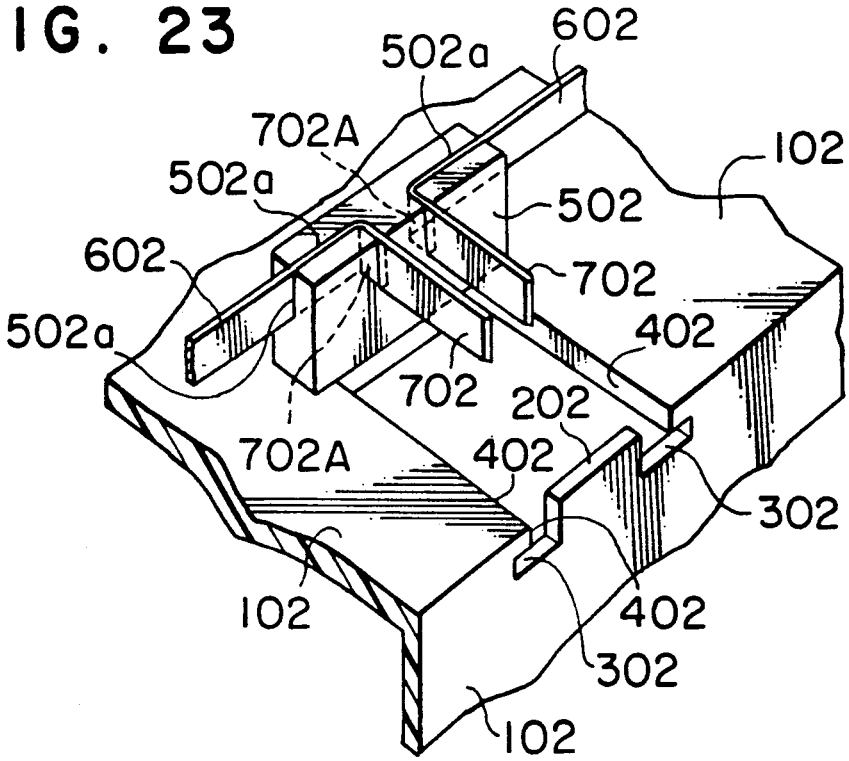

Moreover, in the embodiment indicated in FIG. 23, together with a pair of opposing narrow conducting strips 602 being arranged upright with respect to the surface of insulating base 102, these upright narrow conducting strips 602 along with bases 702A of bent pieces 702 are inserted and supported in narrow slits 502*a*.

Figure 24:
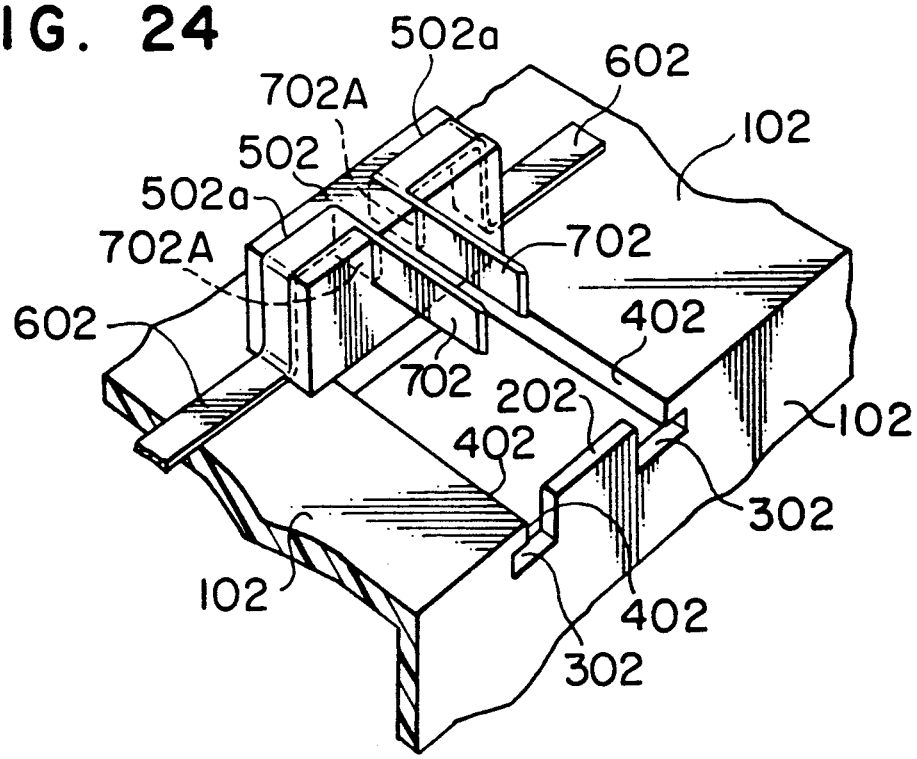

Finally, in the embodiment indicated in FIG. 24, bent pieces 702 are made upright by bending narrow conducting strips 602, which are arranged flat on insulating base 102, in the manner indicated in this same figure. Together with bases 702A being supported by narrow slits 502*a*, narrow conducting strips 602 are inserted and supported in wide slits 502*a*.

Figure 26:
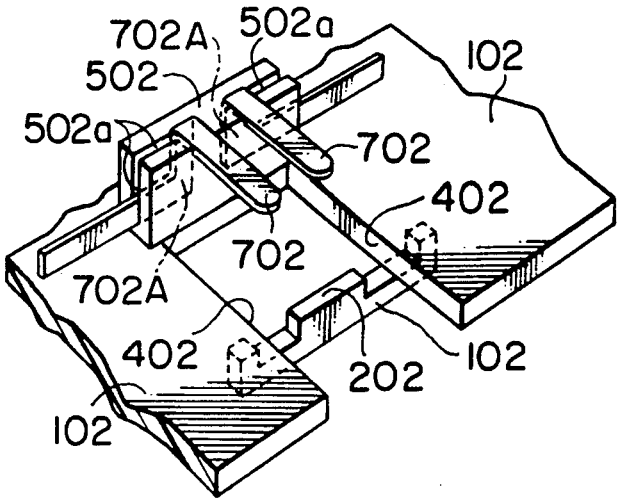
FIG. 26 is a perspective view indicating another embodiment of the insulating base.

In addition, although the previous explanation has discussed the use of an insulating base having an L-shaped cross-section for insulating base 102 in each of the above-mentioned embodiments, insulating base 102 may simply be a plate as indicated in FIG. 26. In this case, projecting edge 202 which transverses notches 302 intermediate to said notches 302 may be securely attached in either an integrated or separate manner to the rear side of insulating base 102 as indicated in FIG. 26.

Figure 27:
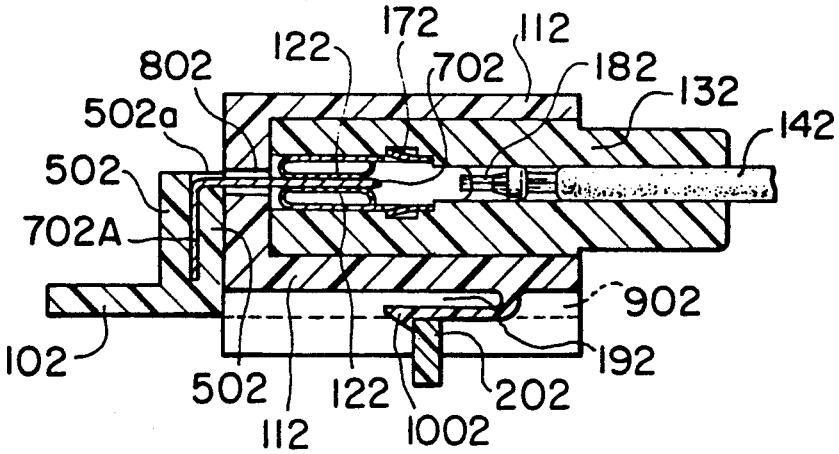
FIG. 27 is a longitudinal sectional side view of the state in which the cylinder is inserted and locked in position on the insulating base.

The insertion and attachment of cylinder 112 onto insulating base 102 may be locked in the notches 302 of said insulating base 102 by providing resilient locking piece 1002, which resiliently engages with the upper portion of the abovementioned projecting edge 202 as indicated in FIG. 27, on the lower surface of cylinder 112.

Furthermore, in these other embodiments, those portions which have been denoted with the same numerals as the previously described basic embodiment denote the same portions as in the basic embodiment.

Moreover, cylinder 112 can be easily removed from insulating base 102 by pushing on the rear surface of insulating base 102 in opposition to the resilient force of resilient locking piece 1002, thereby facilitating replacement during a failure.

The following provides an explanation of a fourth embodiment of the present invention.

By inserting the bases of bent pieces of narrow conducting strips (BUS bars) arranged and fixed on an insulating base into slits formed in a projecting wall on that insulating base, the bent pieces are able to be held in the projecting wall. This prevents the bent pieces from being deformed or displayed by an external force such as that resulting from being attached and removed from the female connecting pieces.

In addition, when a cylinder is pushed onto the front of an insulating base between rail guides in combination with a notch in that insulating base by aligning the grooves on that cylinder, the gaps between resilient locking pieces of the cylinder and the cylinder are narrowed by the force of said grooves applied to the inclined surface of said resilient locking pieces in opposition to the resilient force of said resilient locking pieces. After these gaps are narrowed, the hook portions of said resilient locking pieces engage in the manner of a clicking action with the front end surface of the grooves of the cylinder as a result of the cylinder continuing to be pushed onto the insulating base. Thus, the cylinder is able to be attached to the insulating base in the manner of a so-called "cassette locking" mechanism with a single locking action.

In particular, during this mounting, as the bent pieces of the BUS bars are held in advance in the slits of the projecting wall as stated above, automatic mounting becomes easy.

In addition, the bent pieces are further securely supported and secured as a result of being inserted in female connecting pieces.

The following provides an explanation of a fourth embodiment of the present invention with reference to the drawings.

Firstly, the basic composition of the present invention consists of rail edges 403 having a pair of resilient locking pieces 403A on their front ends formed on both sides of notch 303 opened in edge 203 of plate-shaped insulating base 103 molded from plastic as is indicated in FIG. 28 and FIG. 29.

Narrow bent pieces 703 are provided partially inserted into slits 503*a* along one surface of projecting wall 503 provided in an integrated manner on a surface of insulating base 103 near each of the ends of each rail edges 403, and are formed nearly parallel in between said rail edges 403 on the end portions of, for example, narrow conducting strips 603 in the shape of narrow metal bands arranged on said insulating base 103.

Figure 33:
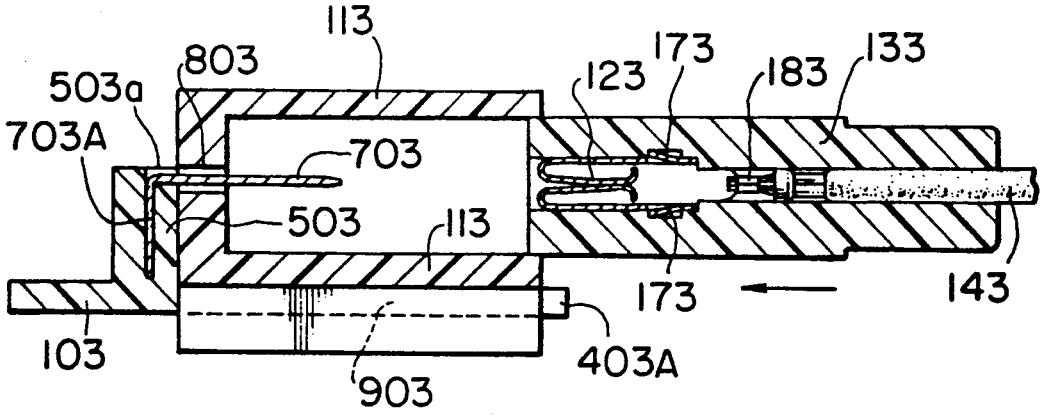
FIG. 33 is a longitudinal sectional side view of the embodiment indicated in FIG. 30.
Figure 34:
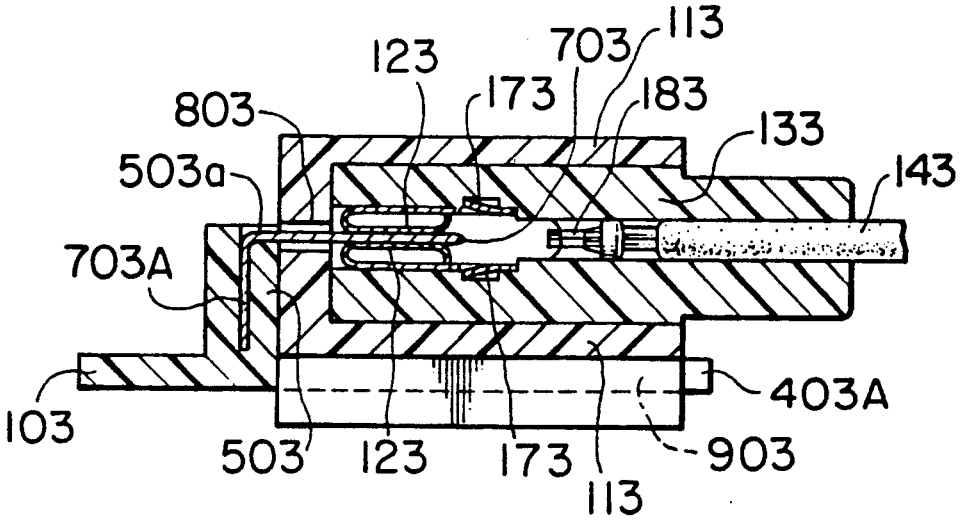
FIG. 34 is a longitudinal sectional side view of the state in which the male engaging member is engaged in the cylinder.
Figure 35:
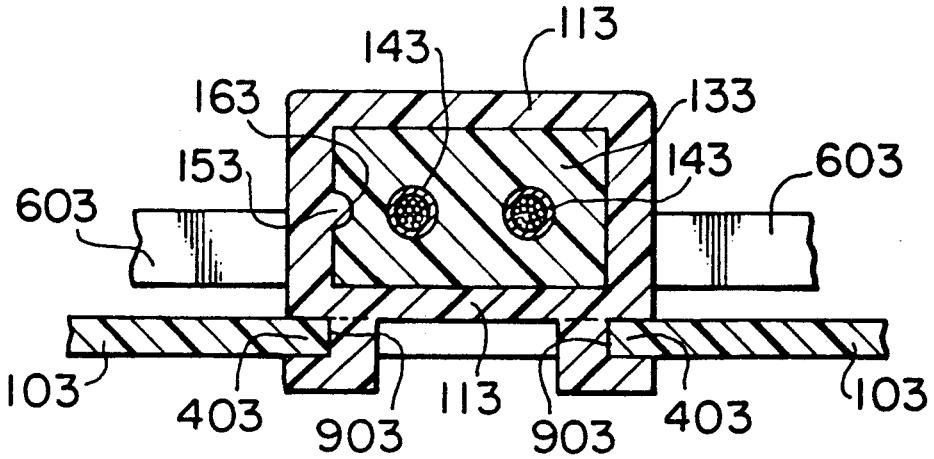
FIG. 35 is a vertical sectional view of the state indicated in FIG. 34.

Moreover, opening 803, through which said bent pieces 703 pass as shown in FIG. 35, and grooves 903, which engage with said rail edges 403, are respectively formed as indicated in FIG. 29 in cylinder 113 made of heat-resistant plastic such as Nylon 66 possessing insulating properties, which is attached to said insulating base 103 as indicated in FIG. 30 and FIG. 34 by locking as indicated in FIG. 33 with said insulating base 103 by means of resilient locking pieces 403A as indicated in FIG. 28 via the state indicated in FIG. 31.

Figure 32:
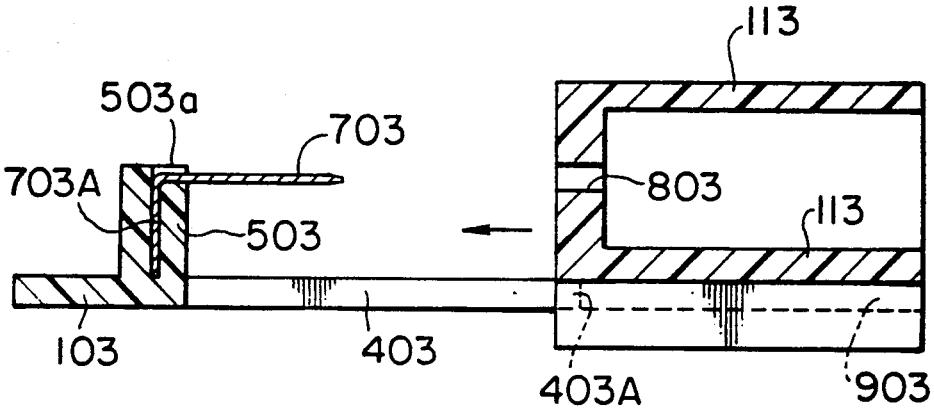
FIG. 32 is a longitudinal sectional side view of the embodiment indicated in FIG. 29.

The electrical connector device of the present invention is then finally composed by comprising male engaging member 133 equipped with female connecting pieces 123 as indicated in FIG. 33 and FIG. 34 into which said bent pieces 703 are inserted as indicated in FIG. 34 and FIG. 35 within said cylinder 113, together with bases 703A of said bent pieces 703 being held tightly in said projecting wall 503 by means of slits 503A as indicated in FIG. 29 and FIG. 32.

Furthermore, numeral 173 in each of the drawings denotes locking tabs for locking female connecting pieces 123 within male engaging member 133 as indicated in FIG. 30. Numeral 143 denotes lead wires having an insulative covering connected to female connecting pieces 123 by means of press fit connectors 183 as indicated in FIG. 33 and FIG. 34. Numerals 153 and 163 denote convex and concave portions for restricting connection orientation which are formed on cylinder 113 and and male engaging member 133, respectively, as indicated in FIG. 30.

Furthermore, cylinder 113 may also be that in which a larger opening 803 is formed. Moreover, cylinder 113 may be in the shape of a tubular cylinder, and corresponding to this, male engaging member 133 may be in the shape of a hollow tube.

In addition, although the previous explanation has been in regard to the example in which two each of narrow insulating strips 603 and bent pieces 703 were provided, 1 each or a plurality of 3 or more each may be arranged on insulating base 103. The number of female connecting pieces 123 as well as the shape of male engaging member 133 and cylinder 113 should then be selected corresponding to that quantity.

As the electrical connector device of the present invention comprises the above-mentioned composition, when cylinder 113 is started to be pushed onto the front of insulating base 103 between rail guides 403 in combination with notch 303 in said insulating base 103 by aligning grooves 903 on said cylinder 113 as indicated in FIG. 29, FIG. 31(*a*) and FIG. 32, gaps 193 between resilient locking pieces 403A and cylinder 113 are narrowed by the force of said grooves 903 applied to the inclined surface of said resilient locking pieces 403A in opposition to the resilient force of said resilient locking pieces 403A as indicated in FIG. 31(*a*). After these gaps are narrowed, hook portions of said resilient locking pieces 403A engage in the manner of a clicking action with the end surface of grooves 903 of cylinder 113 as a result of cylinder 113 continuing to be pushed onto insulating base 103 as indicated in FIG. 30 and FIG. 31(*b*). Thus, cylinder 113 is able to be attached to insulating base 103 in the manner of a so-called "cassette locking" mechanism with a single locking action as indicated in FIG. 30, FIG. 31(*b*) and FIG. 33.

During this insertion, bases 703A of bent pieces 703 of narrow conducting strips 603 (BUS bars), which are arranged and fixed on insulating base 103, are inserted in slits 503*a* formed in projecting wall 503 of insulating base 103 as described above. As bases 703A are held in said projecting wall 503 in advance as indicated in FIG. 32, insertion of cylinder 113 can be performed smoothly, making automatic mounting easy.

Thus, following the above-mentioned insertion, bent pieces 703 are neither deformed or displaced by the external force that results such as during insertion and removal of female connecting pieces 123 within cylinder 113 as is indicated in FIG. 34 and FIG. 35.

Narrow conducting strips 603 can then be connected to an external circuit via bent pieces 703, female connecting pieces 123 and lead wires 143.

In addition, the embodiments indicated in FIG. 36 through FIG. 39 indicate still other embodiments of the present invention.

Figure 36:
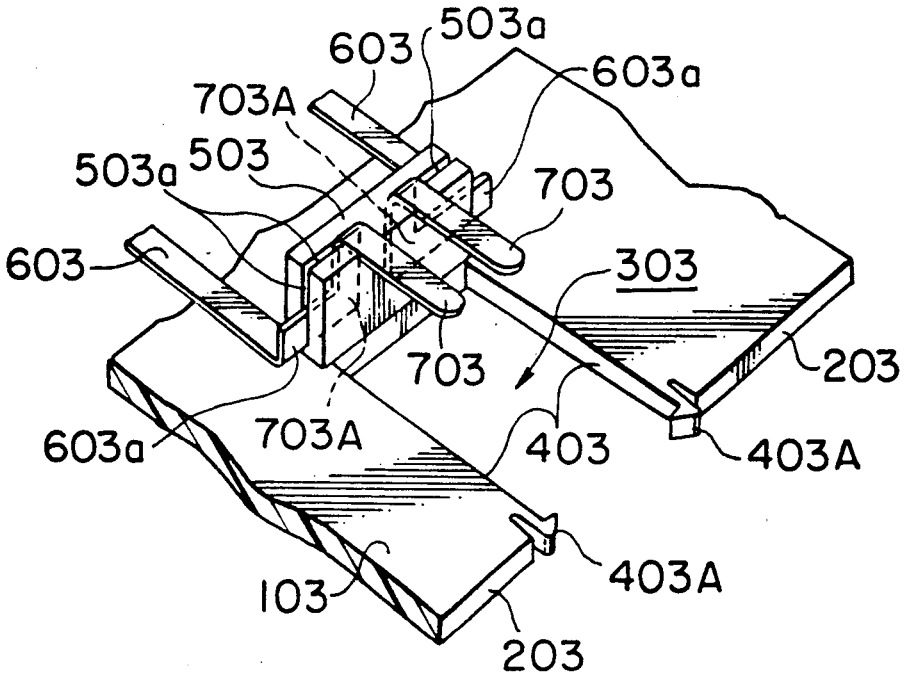
FIG. 36, FIG. 37, FIG. 38 and FIG. 39 are perspective views which indicate the essential portions of other embodiments of the narrow conducting strips and insulating bases, respectively.

Firstly, in the embodiment indicated in FIG. 36, the narrow conducting strips of the above-mentioned embodiment are bent and arranged flat along the surface of insulating base 103 as indicated in this same figure. In addition, upright portions 603*a* of narrow conducting strips 603 are inserted and supported in slits 503*a* of projecting wall 503.

Figure 37:
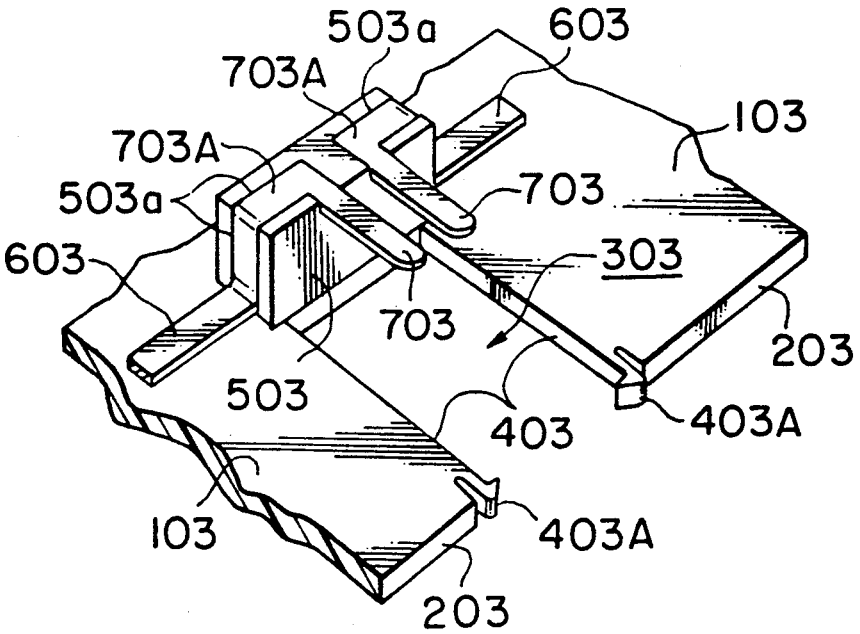

Next, in the embodiment indicated in FIG. 37, together with narrow conducting strips 603, which are arranged flat on insulating base 103, being bent and formed while still flat as indicated in this same figure, these flat narrow conducting strips 603 and bent bases 703A of bent pieces 703 are inserted and supported into wide, shallow slits 503*a* of projecting wall 503.

Figure 38:
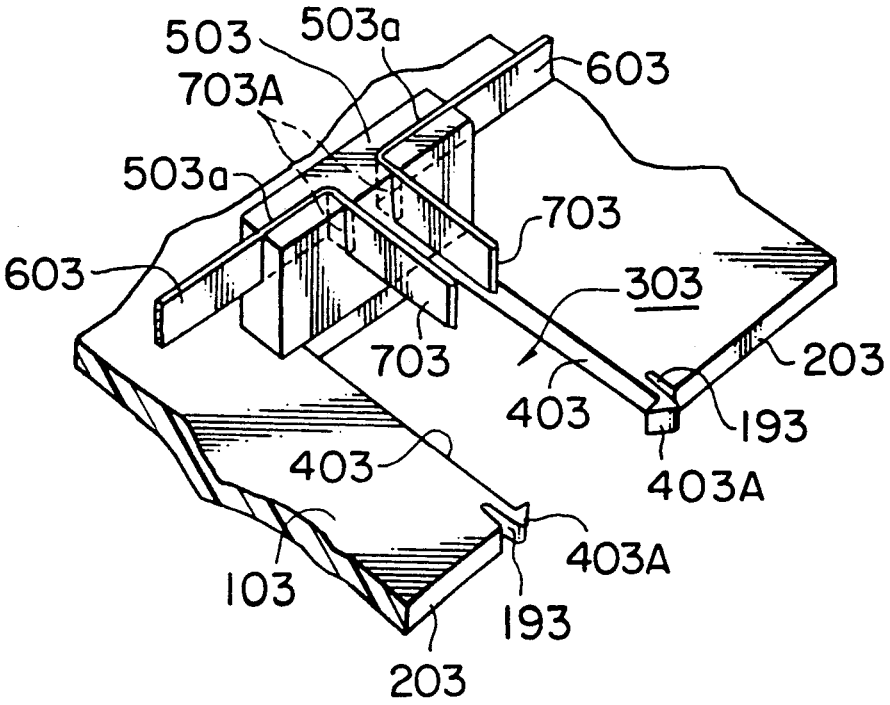

Moreover, in the embodiment indicated in FIG. 38, together with a pair of opposing narrow conducting strips 603 being arranged upright with respect to the surface of insulating base 103, these upright narrow conducting strips 603 along with bases 703A of bent pieces 703 are inserted and supported in narrow slits 503*a*.

Figure 39:
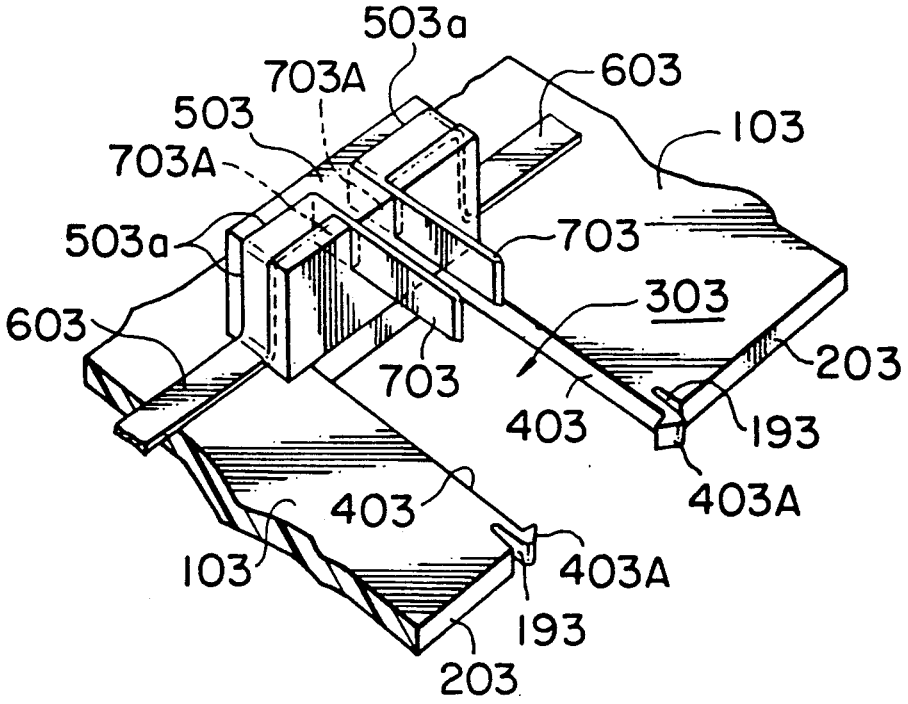

Finally, in the embodiment indicated in FIG. 39, bent pieces 703 are made upright by bending narrow conducting strips 603, which are arranged flat on insulating base 103, in the manner indicated in this same figure. Together with bases 703A being supported by narrow slits 503*a*, narrow conducting strips 603 are inserted and supported in wide slits 503*a*.

Furthermore, in these other embodiments, those portions which have been denoted with the same numerals as the previously described basic embodiment denote the same portions as in the basic embodiment.

Moreover, cylinder 113 can be removed from insulating base 103 by spreading apart resilient locking pieces 403A in opposition to their resilient force with a screwdriver of similar tool, thereby facilitating replacement during a failure.

The following provides an explanation of a fifth embodiment of the present invention.

A fifth embodiment of the present invention will be described with reference to the drawings.

Figure 1C:
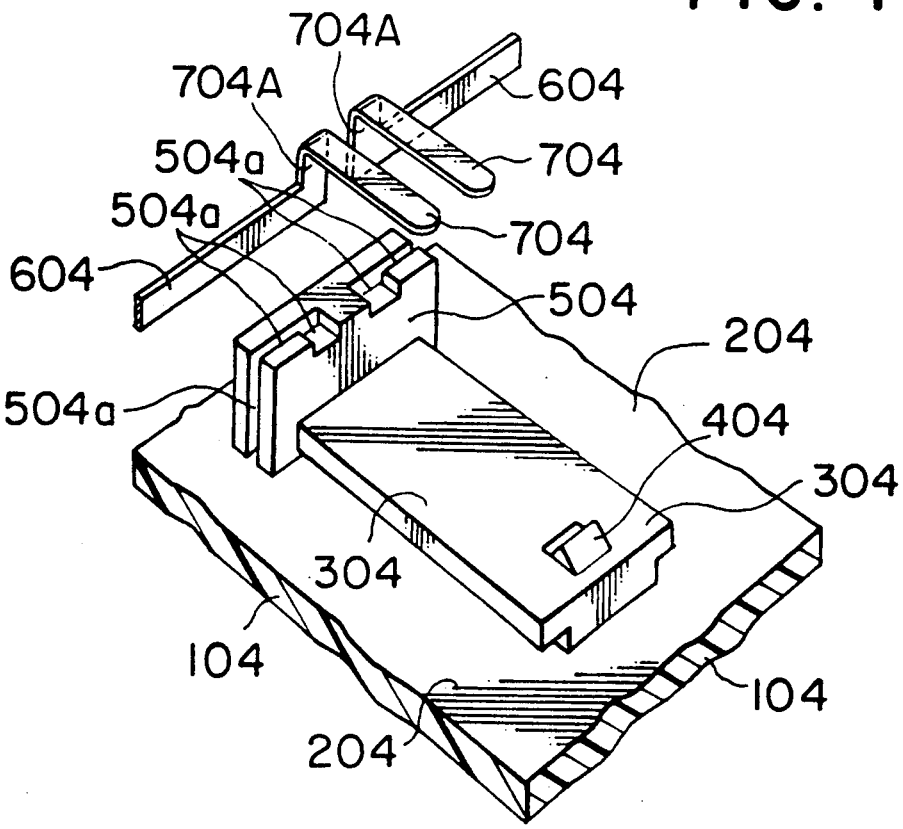
FIG. 1C is a perspective view of the state in which the insulating base and narrow conducting strips are separated.

Firstly, the basic composition of the present invention consists of guide rail 304 in the shape of the letter $\pi$ and at least one resilient locking piece 404 formed on surface 204 of insulating base 104 made of plastic as indicated in FIG. 1C.

Figure 2C:
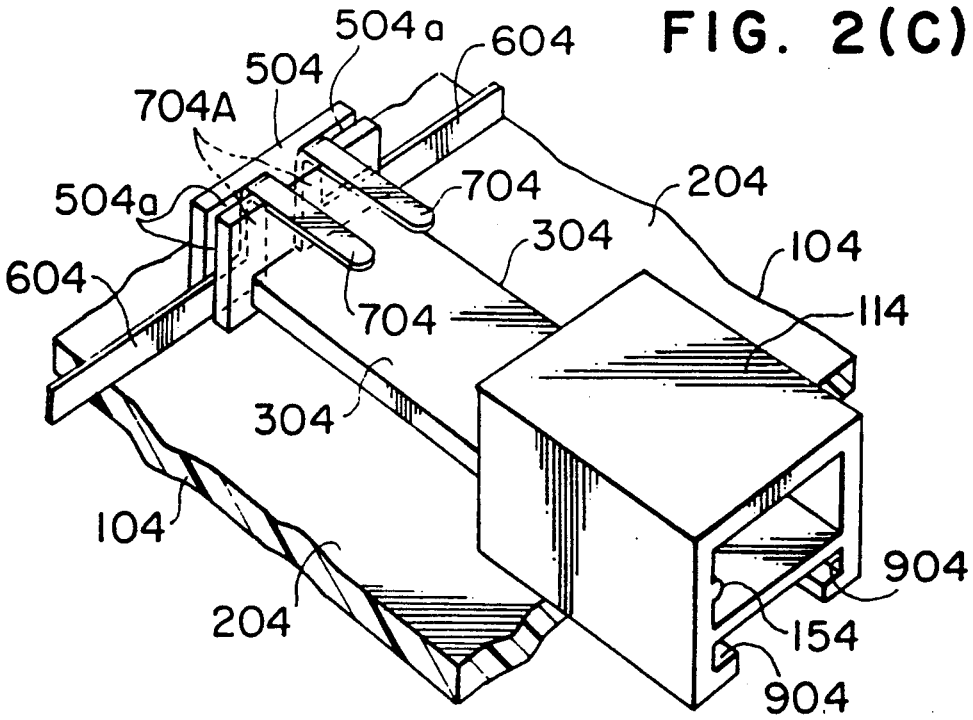
FIG. 2C is a perspective view of the state in which the narrow conducting strips are attached to the insulating base and the cylinder is facing the insulating base.

Bent pieces 704 are provided by being formed and bent nearly in parallel on, for example, the ends of narrow conducting strips 604 in the shape of narrow metal bands as indicated in FIG. 1C, which are used by inserting and fixing in slits 504*a* provided in the longitudinal direction in projecting wall 504 provided near the ending points of said guide rail 304 on the upper surface of said insulating base 104 as indicated in FIG. 2C.

Figure 5E:
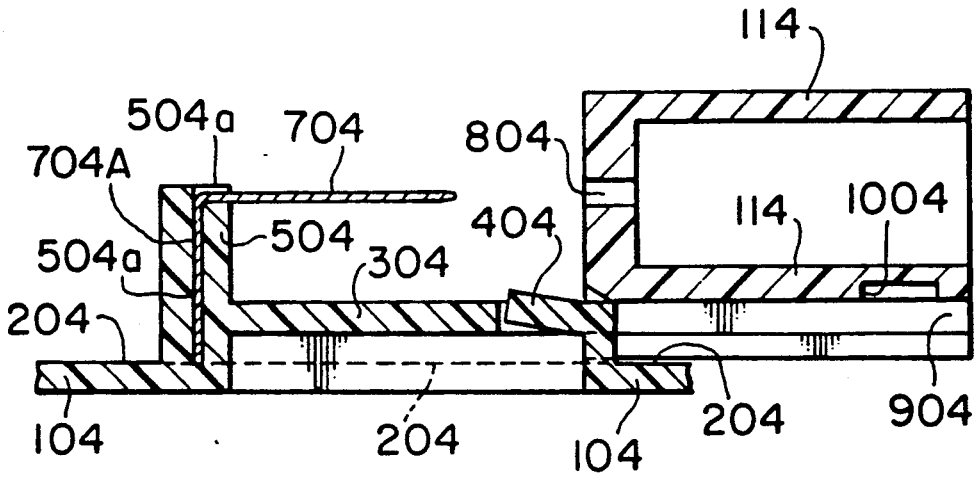
FIG. 5E is a longitudinal sectional side view of the embodiment indicated in FIG. 2C.

In addition, bases 704A of said bent pieces 704 are inserted in the manner described above into slits 504*a* of said projecting wall 504 and held as indicated in FIG. 2C and FIG. 5E.

Figure 6C:
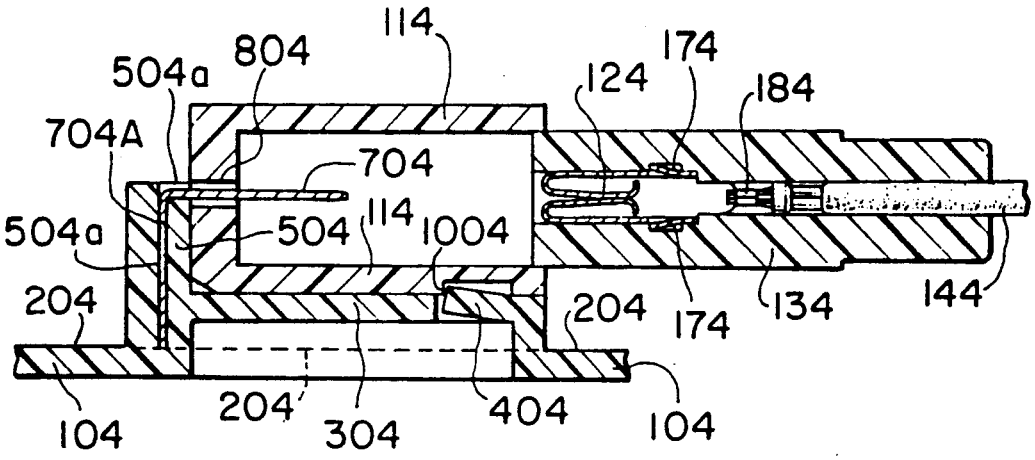
FIG. 6C is a longitudinal sectional side view of the embodiment indicated in FIG. 3C.
Figure 7C:
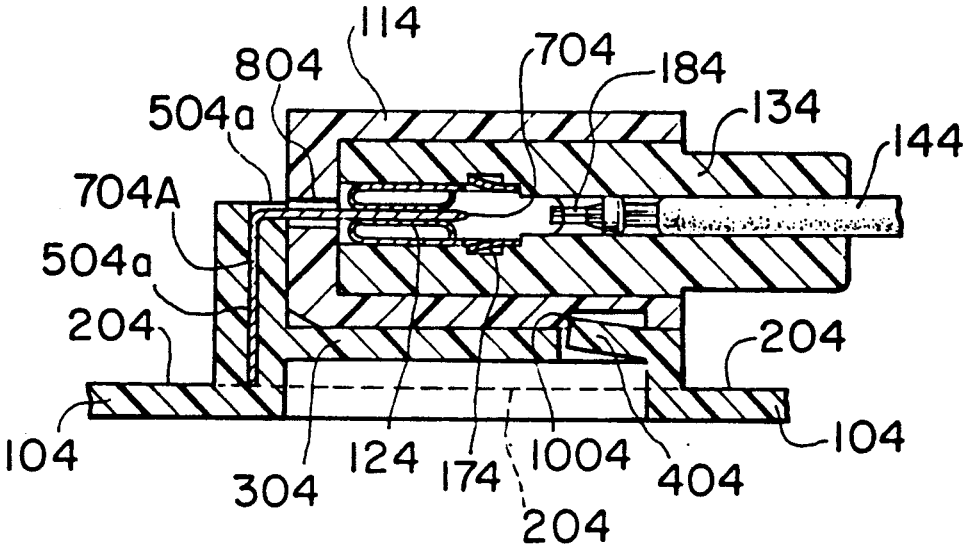
FIG. 7C is a longitudinal sectional side view of the state in which the male engaging member is engaged in the cylinder.
Figure 8C:
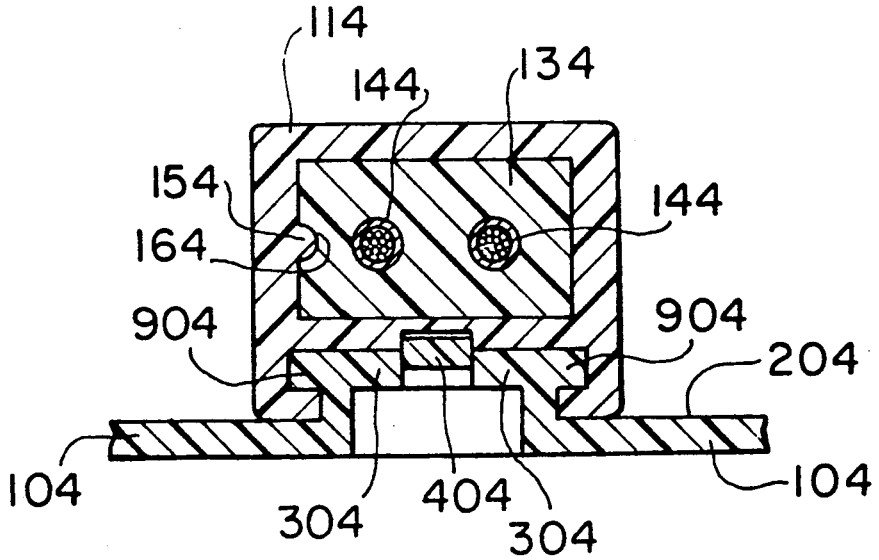
FIG. 8C is a vertical sectional view of the state indicated in FIG. 7C.

Moreover, opening 804, through which said bent pieces 704 pass as shown in FIG. 5E, and guide grooves 904, which engage with said guide rail 304, are formed as indicated in FIG. 2C in cylinder 114 made of heat-resistant plastic such as Nylon 66 possessing insulating properties, which is attached and locks into position on said insulating base 104 as indicated in FIG. 6C via the state indicated in FIG. 5E by means of resilient locking piece 404 through locking edge 1004 as indicated in FIG. 1C The electrical connector device of the present invention is then finally composed by comprising male engaging member 134 equipped with female connecting pieces 124 as indicated in FIG. 3C and FIG. 6C into which said bent pieces 704 are inserted as indicated in FIG. 6C, FIG. 7C and FIG. 8C within said cylinder 114.

Furthermore, numeral 174 in each of the drawings denotes locking tabs for locking female connecting pieces 124 within male engaging member 134 as indicated in FIG. 6C. Numeral 144 denotes lead wires having an insulative covering connected to female connecting pieces 124 by means of press fit connectors 184 as indicated in FIG. 6C and FIG. 7C. Numerals 154 and 164 denote convex and concave portions for restricting connection orientation which are formed on cylinder 114 and and male engaging member 134, respectively, as indicated in FIG. 3C.

Moreover, cylinder 114 may in the shape of a tubular cylinder, and corresponding to this, male engaging member 134 may be in the shape of a hollow tube. In addition, the shape of the upper surface of insulating base 104 and the position at which guide rail 304 is formed should be determined accordingly.

In addition, although the previous explanation has been in regard to the example in which two each of narrow insulating strips 604 and bent pieces 704 were provided, 1 each or a plurality of 3 or more each may be arranged on insulating base 104. The number of female connecting pieces 124 as well as the shape of male engaging member 134 and cylinder 114 should then be selected corresponding to that quantity.

As the electrical connector device of the present invention comprises the above-mentioned composition, after inserting narrow conducting strips 604 from the separated state as indicated in FIG. 1C into slits 504*a* of projecting wall 504 as indicated in FIG. 2C, when guide grooves 904 of cylinder 114 are aligned with and pushed onto guide rail 304 from the right of insulating base 104 as indicated in FIG. 5E, resilient locking piece 404 becomes horizontal due to the force of the lower surface of cylinder 114 that is applied to the upper portion of the inclined surface of said resilient locking piece 404 in opposition to its resilient force. After becoming horizontal, the end surface of said resilient locking piece 404 engages in the manner of a clicking action with the inner surface of locking edge 1004 of cylinder 114 due to the resilient force of said resilient locking piece 404 as indicated in FIG. 6C. Thus, cylinder 114 is able to be attached in the manner of a so-called "cassette locking" mechanism to insulating base 104 with a single locking action as indicated in FIGS. 3C and FIG. 6C.

During this insertion, bases 704A of bent pieces 704 of narrow conducting strips 604 (BUS bars), which are arranged and fixed on insulating base 104, are inserted in slits 504*a* formed in projecting wall 504 of insulating base 104 as described above. As bases 704A are held in said projecting wall 504 in advance as indicated in FIG. 5E, insertion of cylinder 114 can be performed smoothly, making automatic mounting easy.

Thus, following the above-mentioned insertion, bent pieces 704 are neither deformed or displaced by the external force that results such as during insertion and removal of female connecting pieces 124 within cylinder 114 as is indicated in FIG. 7C and FIG. 8C.

Narrow conducting strips 604 can then be connected to an external circuit via bent pieces 704, female connecting pieces 124 and lead wires 144.

FIG. 4B and FIG. 9B are respectively, a perspective view and cross-sectional view of other embodiments of cylinder 114 of the present invention. In these embodiments, the edge of a hole opened in the lower surface of cylinder 114 is used as locking edge 1004 of the embodiment indicated in above-mentioned FIG. 2C and FIG. 5E.

In addition, the embodiments indicated in FIG. 10C through FIG. 13D indicate still other embodiments of the present invention.

Figure 10C:
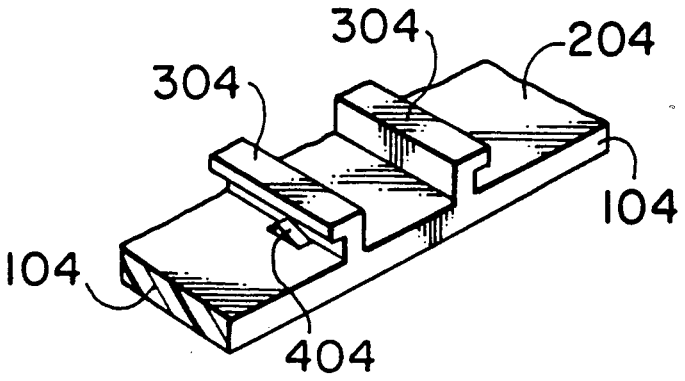
FIG. 10C is a perspective view indicating another embodiment of the guide rail.

Firstly, in the embodiment indicated in FIG. 10C, together with 2 guide rails 304 provided in parallel on insulating base 104, resilient locking piece or pieces 404 are provided on both sides or one side of said guide rails 304.

Figure 11C:
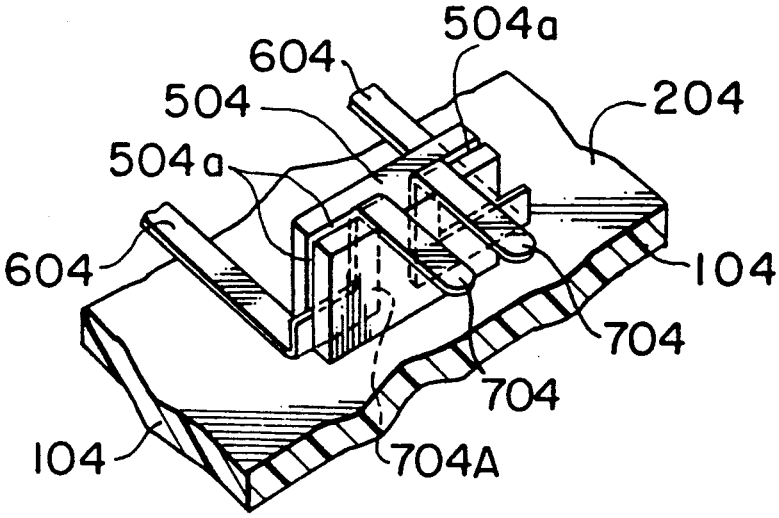
FIG. 11C, FIG. 12C, FIG. 13C and FIG. 13D are perspective views which indicate the essential portions of other embodiments of the narrow conducting strips and insulating bases, respectively.

In addition, in the embodiment indicated in FIG. 11C, together with narrow conducting strips 604 being bent flat and inserted in narrow slits 504*a* of projecting wall 504 as indicated in the same figure, bases 704A of bent pieces 704 are inserted and supported in wide slits 504*a*.

Figure 12C:
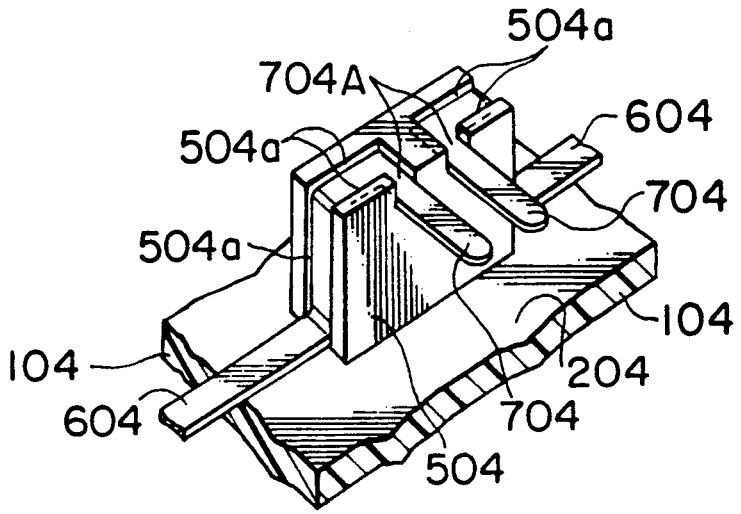

Next, in the embodiment indicated in FIG. 12C, together with narrow conducting strips 604, which are arranged flat on insulating base 104, being bent and formed while still flat as indicated in this same figure, these flat narrow conducting strips 604 and bent bases 704A of bent pieces 704 are inserted and supported in wide, shallow slits 504*a* of projecting wall 504.

Figure 13C:
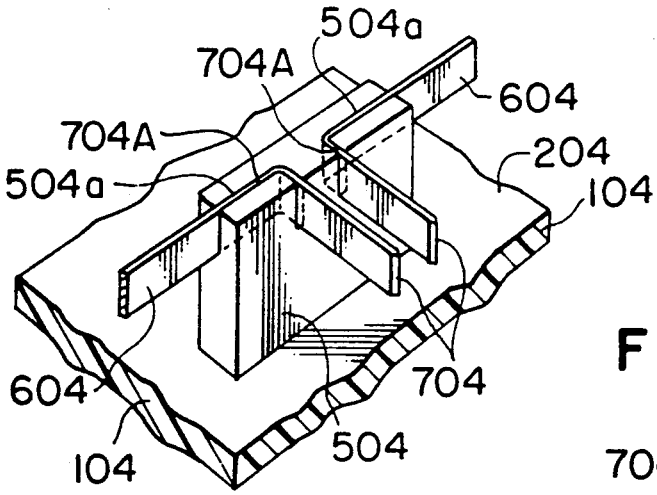

Moreover, in the embodiment indicated in FIG. 13C, together with a pair of opposing narrow conducting strips 604 being arranged upright with respect to the surface of insulating base 104, these upright narrow conducting strips 604 along with bases 704A of bent pieces 704 are inserted and supported in narrow slits 504*a*.

Figure 13D:
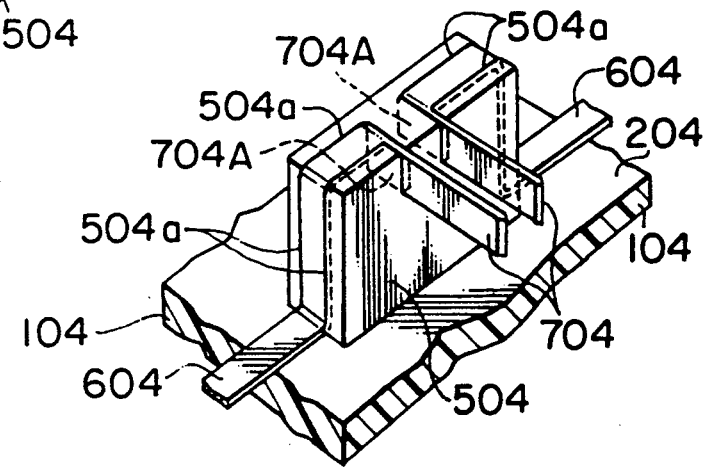

Finally, in the embodiment indicated in FIG. 13D, bent pieces 704 are made upright by bending narrow conducting strips 604, which are arranged flat on insulating base 104, in the manner indicated in this same figure. Together with bases 704A being supported by narrow slits 504*a*, narrow conducting strips 604 are inserted and supported in wide slits 504*a*.

Furthermore, in these other embodiments, those portions which have been denoted with the same numerals as the previously described basic embodiment denote the same portions as in the basic embodiment.

Moreover, if a gap is provided between the front portion of insulating base 104 and the lower surface of cylinder 114, cylinder 114 can be removed from insulating base 104 by pushing down on resilient locking piece 404 in opposition to its resilient force with a screwdriver or similar tool in front of that gap, thereby facilitating replacement during a failure.

Figure 5F:
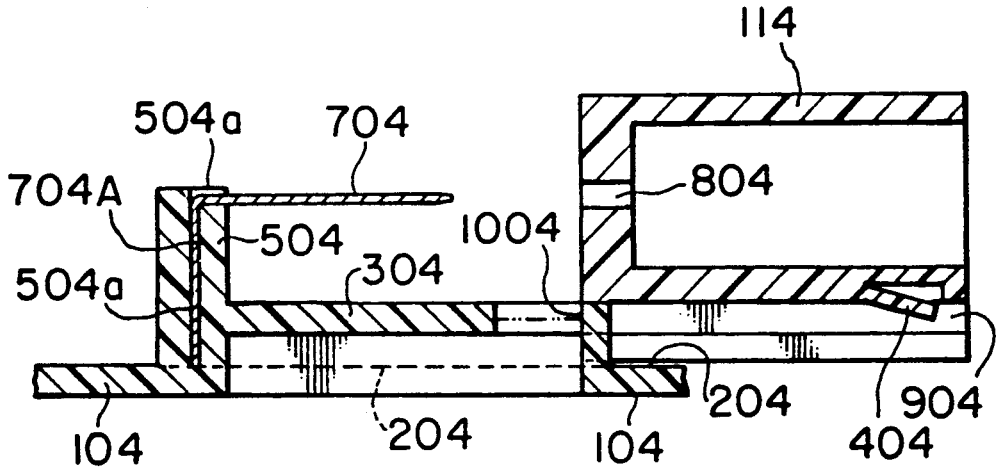
FIG. 5F is a longitudinal sectional side view of another embodiment.

In addition, FIG. 5F indicates an embodiment of the present invention in which locking edge 1004 is provided on insulating base 104 and resilient locking piece 404 is provided on cylinder 114.

What is claimed is:

1. An electrical connector device to allow interconnection between a male connector piece and a female connector plug, said device comprising:

an insulating base having a planar mounting region and including a restraining wall which projects upwardly within a transverse plane relative to said planar mounting region of said insulating base, said restraining wall defining at least one open-ended slit oriented parallel to said transverse plane within which said restraining wall projects;

a tubular housing establishing an interior space which is sized and configured to accept the female connector plug therewithin, said housing being coupled to the mounting region of said insulating base and having a forward end which is engaged with said restraining wall and a rearward end for receiving the female connector plug; and at least one electrically conductive strip having a leg portion which is positioned within said at least one slit of said restraining wall, and a terminal end portion which forms the male connector piece, said terminal end portion being bent so as to be disposed within a plane which is parallel to but spaced from said planar mounting region to thereby extend outwardly from said restraining wall and into said interior space of said tubular housing to thereby be mateable with said female connector plug inserted therewithin.

2. A connector as in claim 1, wherein said tubular housing includes opposing side pieces, and said base includes a number of projections for engagement with said side pieces of said tubular housing.

3. A connector as in claim 1, wherein said insulating base includes a pair of opposed guide walls upwardly extending from said mounting region of said insulating base and being laterally positioned relative to said restraining wall, said pair of opposed guide walls including upper retaining flanges which project inwardly towards one another such that said guide walls and said retaining flanges thereof at least partially bound said tubular housing so as to couple said housing to said insulating base.

4. A connector as in claim 1, wherein said insulating base includes a pair of raised oppositely extending guide rails; and said tubular housing includes a pair of inwardly extending lower flanges each defining a guide groove which mates with a respective one of said guide rails so as to couple said housing to said insulating base.

5. A connector as in any one of claims 1–4, wherein one of said base and said tubular housing defines a locking edge, and the other of said base and said tubular housing includes a resilient locking piece which is engaged with said locking edge so as to lockably couple said tubular housing to said base.

6. A connector as in claim 5, wherein said tubular housing includes said resilient locking piece, and said base defines said locking edge.

7. A connector as in claim 1, wherein said mounting region of said insulating base includes an opposed pair of rail edges which establishes an open region in advance of said restraining wall;

said tubular housing defines a pair of lower grooves which mate with respective ones of said rail edges so as to couple said housing to said insulating base.

8. A connector as in claim 7, wherein each said rail edge terminates in a resilient locking member which engages said other end of said housing and thereby lockably couples said housing to said insulating base.

9. A connector as in claim 1, wherein said housing defines a pair of slits each oriented in a plane parallel to said restraining wall, and wherein a pair of electrically conductive strips are provided, each having a leg portion positioned within a respective one of said slits, and a bent terminal end portion which extends outwardly from said restraining wall parallel to said planar mounting surface.

10. The assembly comprising a female connector plug which is insertably received within a connector according to claim 1 so as to establish electrical interconnection with said male connector piece.

11. The assembly as in claim 10, wherein said female connector plug and said tubular housing respectively include mating concave and convex surfaces which establish insertion orientation of said female connector plug within said interior space of said tubular housing.

* * * * *